US007012619B2

(12) United States Patent
Iwata et al.

(10) Patent No.: US 7,012,619 B2
(45) Date of Patent: Mar. 14, 2006

(54) DISPLAY APPARATUS, DISPLAY METHOD, DISPLAY CONTROLLER, LETTER IMAGE CREATING DEVICE, AND COMPUTER-READABLE RECORDING MEDIUM IN WHICH LETTER IMAGE GENERATION PROGRAM IS RECORDED

(75) Inventors: Satoshi Iwata, Kawasaki (JP); Shoji Suzuki, Kawasaki (JP); Nobuaki Usui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 41 days.

(21) Appl. No.: 09/908,621

(22) Filed: Jul. 20, 2001

(65) Prior Publication Data

US 2002/0060689 A1 May 23, 2002

(30) Foreign Application Priority Data

Sep. 20, 2000 (JP) ..... 2000-285592

(51) Int. Cl.
*G09G 5/00* (2006.01)

(52) U.S. Cl. ..... 345/613; 345/55; 345/467; 345/589; 345/597; 345/690; 382/266

(58) Field of Classification Search ..... 345/467, 345/471, 596, 613, 694, 55, 59; 382/299, 382/301, 205

See application file for complete search history.

(56) References Cited

U.S. PATENT DOCUMENTS

| | | | | |
|---|---|---|---|---|
| 5,625,772 | A | 4/1997 | Yamazaki et al. | |
| 5,684,510 | A | 11/1997 | Brassell et al. | |
| 5,966,134 | A * | 10/1999 | Arias | 345/589 |
| 6,097,398 | A * | 8/2000 | Numata | 345/603 |
| 6,188,385 | B1 * | 2/2001 | Hill et al. | 345/614 |
| 6,229,521 | B1 * | 5/2001 | Yip | 345/611 |
| 6,661,429 | B1 * | 12/2003 | Phan | 345/694 |
| 6,750,875 | B1 * | 6/2004 | Keely, Jr. et al. | 345/613 |

FOREIGN PATENT DOCUMENTS

JP 5-40463 2/1993

* cited by examiner

*Primary Examiner*—Matthew C. Bella
*Assistant Examiner*—Antonio Caschera
(74) *Attorney, Agent, or Firm*—Staas & Halsey LLP

(57) ABSTRACT

A display apparatus includes a display section having plural display elements for displaying a display object with N (natural number larger than one) display elements per pixel, and a display control section, communicably connected to the display section, for controlling the displaying state of the display section in terms of color factors of the respective display elements in such a manner that the display object is displayed with each of the display elements corresponding to one or more pixels on the display object. It is possible to display a small letter, serving high visibility.

15 Claims, 23 Drawing Sheets

The case of a Japanese character "hiragana"

Font Image used for creating new font image on flat panel display

The pseudo-image of a letter on flat panel display

The case of an English letter

Font Image used for creating new font image on flat panel display

The pseudo-image of a letter on flat panel display

The case of a Japanese character "kanji"

Font Image used for creating new font image on flat panel display

The pseudo-image of a letter on flat panel display

FIG. 9A

| DIRECTED BRIGHTNESS VALUES | R'BRIGHTNESS | G'BRIGHTNESS | B'BRIGHTNESS |
|---|---|---|---|
| 0 | 0 | 0 | 0 |
| 1 | 1 | 0 | 1 |
| : | : | : | : |
| 10 | 6 | 4 | 10 |
| : | : | : | : |
| 100 | 60 | 38 | 100 |
| : | : | : | : |
| : | : | : | : |
| 200 | 120 | 77 | 200 |
| : | : | : | : |
| 256 | 153 | 98 | 255 |

FIG. 9B

| DIRECTED BRIGHTNESS VALUES | R'BRIGHTNESS | G'BRIGHTNESS | B'BRIGHTNESS |
|---|---|---|---|
| 0 | 6 | 4 | 10 |
| : | : | : | : |
| 100 | 58 | 37 | 96 |
| : | : | : | : |
| : | : | : | : |
| 256 | 153 | 98 | 255 |

| | | |
|---|---|---|
| $f_{11}$ | $f_{12}$ | $f_{13}$ |
| $f_{21}$ | $f_{22}$ | $f_{23}$ |
| $f_{31}$ | $f_{32}$ | $f_{33}$ |

FILTER

CHARACTER IMAGE $$\frac{0+127+0}{3}$$

DISPLAY PIXELS

FILTER

FIG. 17A

| | | |
|---|---|---|
| E1 | E2 | E1 |
| E2 | E3 | E2 |
| E1 | E2 | E1 |

4×E1+4×E2+E3=1.0

FIG. 17B

| | | |
|---|---|---|
| E4 | E4 | E4 |
| E5 | E5 | E5 |
| E4 | E4 | E4 |

6×E4+3×E5=1.0

FIG. 17C

| | | |
|---|---|---|
| E6 | E7 | E6 |
| E6 | E7 | E6 |
| E6 | E7 | E6 |

6×E6+3×E7=1.0

FIG. 17D

| | | |
|---|---|---|
| E8 | E8 | E8 |
| E8 | E9 | E8 |
| E8 | E8 | E8 |

8×E8+9×E9=1.0

(K.T. SPOEHR, S.W. LEHMKUHLE "COGNITIVE SCIENCE AND INFORMATION PROCESSING")

ORIGINAL IMAGE

×

EXAMPLE OF FILTER

→

HALFTONING FONT

DISPLAY APPARATUS, DISPLAY METHOD, DISPLAY CONTROLLER, LETTER IMAGE CREATING DEVICE, AND COMPUTER-READABLE RECORDING MEDIUM IN WHICH LETTER IMAGE GENERATION PROGRAM IS RECORDED

BACKGROUND OF THE INVENTION (1) Field of the Invention

The present invention relates to a display apparatus which usually displays a display object with rectangular red (R), green (G), and blue (B) display elements, each corresponding to one pixel. More particularly, the present invention relates to a display apparatus, a display method, a display controller, and a letter image generation device for use in displaying high resolution letters (i.e., small letters), as well as to a computer-readable recording medium in which a letter image generation program is performed.

(2) Description of the Related Art

In association with recent pursuit of a lighter-weight display apparatus (personal computer) flat-panel type typified by a liquid crystal color display apparatus, use of the display apparatus in a transportable manner has now become predominant. Against such a backdrop, there has been sought display of high-resolution letters and a color image display on a smaller screen.

For instance, indication of annotations or Japanese kana characters is indispensable for displaying Japanese contents, such as contents of books and magazines. Japanese kana characters are displayed in substantially half or less the size in which a text is to be displayed (e.g., in 6-point or smaller letters when text is being displayed in 12-point letters).

Indication of such Japanese kana letters on a display apparatus requires a resolution of 180 dpi (dots per inch) or more. Even when a conventional color display of flat-panel type typified by a liquid crystal display is used in a portable terminal, it is difficult to achieve such a high resolution.

A known related-art method for displaying such high-resolution monochrome letters is a halftoning technique using grayscale fonts or sub-pixel fonts.

In connection with grayscale fonts, edges of a letter are displayed in multiple shades of gray, and a font is produced by utilization of halftones. Jaggies are suppressed by reducing inconsistencies in density in the edges and smoothing the edges with upper, lower, left, and right adjacent patterns. Even when pixels are relatively large compared with the display size of letters, the letters can be read. In other words, jagged edges of a letter (i.e., jaggies) can be lessened.

FIGS. 21A through 21C are illustrations for describing a method of forming grayscale fonts (i.e., a halftoning technique). FIG. 21A is an enlarged view showing a portion of a letter image before processing. FIG. 21B is a view showing an example of a smoothing filter to be used for forming a grayscale font. FIG. 21C is an enlarged view showing a portion of a formed grayscale font.

According to the halftoning technique to be used for forming a grayscale font, smoothing filters formed from a 3×3 pixel matrix shown in FIG. 21B (wherein 1/16 1/8 1/16, 1/8 1/4 1/8, 1/16 1/8 1/16) are superimposed on a letter image formed from two shades of gray shown in FIG. 21A. As a result, halftone fonts (grayscale fonts) such as those shown in FIG. 21C are formed.

Provided that a letter image before being halftoned is denoted as F, a smoothing filter is denoted as "f," a grayscale font to be formed is denoted as Fg, and a superimposing operation is denoted as ⊚, the method of forming grayscale fonts can be expressed as follows:

$$Fg=F \circledcirc f$$

where, f=(1/16 1/8 1/16, 1/8 1/4 1/8, 1/16 1/8 1/16)

In connection with sub-pixel fonts, letters are halftoned by individual use of R-G-B elements and by dispersing the value of each pixel in a horizontal direction.

Provided that a letter image before being halftoned is denoted as F, an energy dispersion coefficient is denoted as $\epsilon$ (e.g., $\epsilon$=0.11, 0.22, 0.33, 0.22, 0.11), a sub-pixel font to be produced is denoted as Fs, and a superimposing operation is denoted as ⊚, the method of forming a sub-pixel font can be expressed as follows:

$$Fs=F \circledcirc \epsilon$$

In connection with sub-pixel fonts;, the size into which a letter is half toned by use of the energy dispersion coefficient $\epsilon$ is determined on a per-element basis. Hence, halftoning of a letter using a sub-pixel font yields improved resolution as compared with halftoning of a letter using a grayscale font.

When a display apparatus displays Japanese document contents, text of the contents is displayed in a point size of, e.g., 10 (10 dots at 72 dpi). In this case, Japanese kana characters above kanjis must be displayed with letter images of about half the size of the letters.

However, in the related-art halftoning method, it is difficult to resolve a 5-point letter. For instance, when letters of point size 5 or thereabouts are displayed on a common liquid crystal display apparatus, letter images are displayed in the form of an about 6×6 pixel matrix or a 7×7 pixel matrix in the resolution of about 100 pixels/inch (dpi).

In this case of such halftoning method, an interval (a stroke pitch) at which pixels constituting a letter come closest to each other corresponds to one pixel. When letters of point sizes 5 or less are displayed on a display apparatus having a resolution of 100 dpi or thereabouts, pixels constituting a letter are merged, thus posing difficulty in letter recognition.

The halftoning technique using grayscale fonts involves spread of a minimum of three pixels (i.e., collapse of a stroke) arising in both horizontal and vertical directions. Even in the case of a halftoning method using sub-pixel elements, spread of five elements (i.e., 5/3 pixels) arises in a horizontal direction (i.e., a direction in which R-G-B elements are to be arranged). As a result, pixels constituting letters are merged, thereby posing difficulty in letter recognition.

SUMMARY OF THE INVENTION

With foregoing problems in view, it is an object of the present invention to provide a display apparatus, a display method, a display controller, a letter image creating device and a computer-readable recording medium, in which a letter image creating program is recorded, for displaying highly-visible letters in high resolution.

To accomplish the above-mentioned object, there is provided a display apparatus comprising: a display section, having a plurality of display elements for displaying a display object with N (N is a natural number larger than one) display elements per pixel; and a display control section, communicably connected to the display section, for controlling the displaying state of the display section in terms of color factors of the respective display elements in such a manner that the display object is displayed with each of the display elements corresponding to one or more pixels of the display object.

With this display apparatus, since each of the display elements is corresponding to one or more pixels, N display elements displays a plurality of pixels of the display object.

As a preferable feature, each of the display elements may be rectangular; the N display elements may be successively arranged in a predetermined direction perpendicular to the longitudinal center line of the individual rectangular display element; and the display control section may render the display section to display the display object with the N rectangular display elements each corresponding to M (M is a natural number) pixels successively arranged along the longitudinal center line of each of the rectangular display element so that the N display elements are represented by a group of pixels in an M×N matrix.

As a result, it is possible for the N display elements to being corresponding to the (M×N) display elements.

As another preferable feature, the display object may be an image of a letter; the display control section may include (a) a normal letter image information obtaining section for obtaining normal letter image information of a letter image which is M times larger than the original size of the last-named letter image in a longitudinal direction parallel to the longitudinal center lines of the display elements and N times larger than the original size of the letter image in the predetermined direction with the N display elements corresponding to each of the pixels of the letter image, and (b) an element brightness value computing section for computing first brightness values of the individual rectangular display elements, each corresponding to the M pixels successively arranged in the longitudinal direction, based on pixel values, provided one for each of the M pixels, of the normal letter image information; and the display control section may vary the color factors of the display elements in accordance with the first brightness values, which are computed by the element brightness value computing section, in such a manner that the display section displays the letter image in the original size.

Thereby, the display object can be displayed with the individual display element corresponding M pixels successively arranged in the longitudinal direction.

As still another preferable feature, the N display elements may be different in color from one another; and the display apparatus may further comprise a brightness value converting section for converting, if the N display elements are identical in brightness value, the first brightness values to second brightness values in accordance with lightness characteristics of the respective N display elements in such a manner that the N display elements are identical in lightness.

As a result, if the N display elements are identical in brightness, the N display elements are identical in lightness upon display of the display object.

As a second generic feature of the present invention, there is provided a computer-readable recording medium in which a letter image creating program for creating a letter image to be displayed on a display section of a display apparatus is recorded, the display section including N (N is a natural number larger than one) rectangular display elements successively arranged in a predetermined direction perpendicular to the longitudinal center line of the individual display element, each of the N display elements corresponding to M (M is a natural number) pixels arranged along the longitudinal center line of the display element so that the N display elements are represented by a group of pixels in an M×N matrix, wherein the letter image creating program instructs a computer to function as the following: a normal letter image information obtaining section for obtaining normal letter image information of a letter image which is M times larger than the original size of the last-named letter image in a longitudinal direction parallel to the longitudinal center lines of the display elements and N times larger than the original size of the letter image in the predetermined direction with the N display elements corresponding to a pixel of the letter image; and an element brightness value computing section for computing first brightness values of the individual rectangular display elements, each corresponding to the M pixels successively arranged in the longitudinal direction based on pixel values, provided one for each of the M pixels, of the normal letter image information.

Therefore, the N display elements are represented by a group of pixels in an M×N matrix of the latter image that is displayed, and first brightness values of the individual rectangular display elements, each corresponding to the M pixels successively arranged in the longitudinal direction is computed.

As the third generic feature, there is provided a method of displaying a display object on a display section of a display apparatus by controlling a plurality of display elements constituting the display section, in which the display object is displayed with N (N is a natural number larger than one) display elements, each of the display elements corresponding to one or more pixels.

As the fourth generic feature, there is provided a display controlling apparatus for controlling the displaying state of a display section of a display apparatus in terms of color factors of a plurality of display elements, which constitute the display section, in such a manner that the display object is displayed on the display section with N (N is a natural number larger than one) display elements, each of the display elements corresponding to one or more pixels.

As the fifth generic feature, there is provided a letter image creating apparatus, communicably connected to a display section of a display apparatus, for creating a letter image that is to be displayed on the display section, in which N (N is a natural number larger than one) rectangular display elements successively arranged in a predetermined direction perpendicular to the longitudinal center line of the individual display element, each of the N display elements corresponding to M (M is a natural number) pixels successively arranged along the longitudinal center line of the display element so that the N display elements are represented by a group of pixels in an M×N matrix, the apparatus comprising: a normal letter image information obtaining section for obtaining normal letter image information of a letter image which is M times larger than the original size of the last-named letter image in a longitudinal direction parallel to the longitudinal center lines of the display elements and N times larger than the original size of the letter image in the predetermined direction with the N display elements corresponding to a pixel of the letter image; and an element brightness value computing section for computing first brightness values of the individual rectangular display elements, each corresponding to the M pixels successively arranged in the longitudinal direction, based on pixel values, provided one for each of the M pixels, of the normal letter image information.

As a further preferable feature, the element brightness value computing section may obtain an average of the pixel values of the M pixels, and also computes the first brightness values of the corresponding rectangular display element based on the average.

As still further preferable feature, the N rectangular display elements may be different in color from one another; and the letter image creating apparatus further may comprise a brightness value converting section for converting, if the N display elements are identical in brightness value, the first brightness values to a second brightness values in accordance with lightness characteristics of the individual N rectangular display elements in such a manner that the N display rectangular elements are identical in lightness.

As a further preferable feature, the element brightness value computing section may serve to function as the brightness value converting section; and the element brightness value computing section may perform the conversion of the first brightness values to the second brightness values simultaneously with the computation of the first brightness values.

As a further preferable feature, the element brightness value computing section may be connected to the display section via the brightness value converting section; and the brightness value converting section may perform the converting on the first brightness values that is to be directed to the each rectangular display elements.

As a further preferable feature, the N rectangular display elements may be three elements in red, green and blue, respectively; and if the three display elements are identical in brightness value, the brightness value converting section may perform the conversion of the first brightness values in such a manner that: a ratio of the second brightness values of the red, green, and blue elements is 0.600±0.100:0.384±0.100:1.000±0.100.

As a further preferable feature, the letter image creating apparatus may further comprise a smoothing section for smoothing the first brightness values of the respective rectangular display elements with a matrix-shaped filter, as each of the display elements is regarded as M elements successively arranged in the longitudinal direction and having one M-th of the first brightness value obtained by the element brightness value computing section.

As a further preferable feature, the letter image creating apparatus may further comprise a smoothing section for smoothing each the pixel values of the normal letter image information with a matrix-shaped filter.

With the forgoing features of the display method, the display apparatus, the display controlling apparatus, the letter image creating apparatus, and the computer-readable recording medium in which a letter image creating program is recorded, it is possible to guarantee the following advantageous results:

(1) The display section can display a letter image in a higher resolution.

(2) Since an average of the pixel values of the M pixels are computed and the first brightness values of the corresponding rectangular display element based on the average, it is possible to compute first brightness value of the corresponding rectangular display element with ease.

(3) A letter image greater than a standard size is displayed in the normal display mode thereby enabling a high speed processing due to a simple display control. On the other hand, since a letter image equal to or smaller than the standard size is displayed in a high-resolution display mode, it is possible for the small letter image to being displayed in a high resolution.

(4) Since, if the N display elements emit light in identical brightness, the first brightness values of the N display elements are converted to the second brightness value in such a manner that the N display elements are identical in lightness, it is possible to display uniform letter image in terms of lightness on the display unit, improving displayed image.

(5) Since the element brightness value computing section perform the conversion of the first brightness value to the second brightness values simultaneously with the computation of the first brightness values, it is possible to performs process for displaying a display object at a high speed, and also to simplify hardware configuration, reducing the cost for the display apparatus.

(6) Since an average of the pixel values of the M pixels is computed, whereupon the first brightness value is computed based on the average, it is possible to reduce the load on the display controlling apparatus, enabling a high-speed process.

(7) Each display elements emit light identical in lightness thereby uniformly displaying an display object on the display section.

(8) Since the first brightness values of the respective display elements are smoothed with a matrix-shaped filter, as each of the display elements are regarded as M elements successively arranged in the longitudinal direction and having one M-th of the first brightness values, it is possible to display a letter image reduced in jaggies of the edges on the display section, serving a high-resolution letter image.

(9) Since matrix-shaped filters are square-lattice shape, it is possible to guarantee isotropy with respect to a more detailed area by applying thereto square filters. Further, it is possible to facilitate filter design because matrix anisotropy does not have to be considered. It is also possible to narrow the area affected by the filters as compared with conventional filters.

Other objects and further features of the present invention will be apparent from the following detailed description when read in conjunction with the accompanying drawings.

BRIEF DESCRIPTION OF THE DRAWINGS

FIGS. 1A and 1B show a display apparatus according to a first embodiment of the present invention, wherein FIG. 1A is an enlarged view of a display section of the display apparatus, and FIG. 1B is a block diagram schematically showing a functional configuration of the display section;

FIGS. 6A and 6B are illustrations for describing a modification of the first embodiment of the present invention, wherein FIG. 6A is an enlarged view of a display section, and FIG. 6B is a block diagram showing the functional construction of the display section;

FIGS. 8A and 8B are drawings for describing a display apparatus according to a second embodiment of the present invention, wherein FIG. 8A is an enlarged view showing a display section of the display apparatus, and FIG. 8B is a block diagram showing a functional construction of the display section;

FIGS. 9A and 9B show tables of brightness values, wherein each RGB display elements achieve an identical lightness when the RGB display elements emit light in accordance with identical brightness values;

FIGS. 13A and 13B are illustrations for describing a display apparatus according to a third embodiment of the present invention, wherein FIG. 13A is an enlarged view showing a display section of the display apparatus, and FIG. 13B is a block diagram showing the functional construction of the display section;

FIGS. 17A through 17D respectively show example smoothing filters;

BRIEF DESCRIPTION OF THE PREFERRED EMBODIMENTS

Preferred embodiments of the present invention will be described hereinbelow with reference to the accompanying drawings.

Figure 1A:
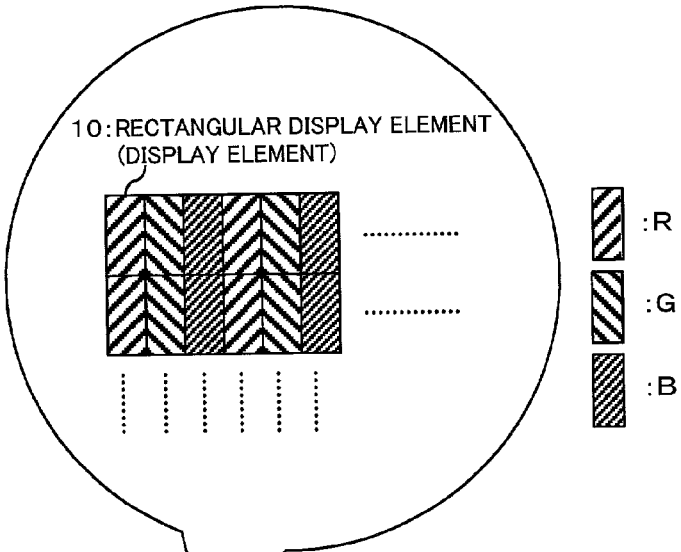
Figure 1B:
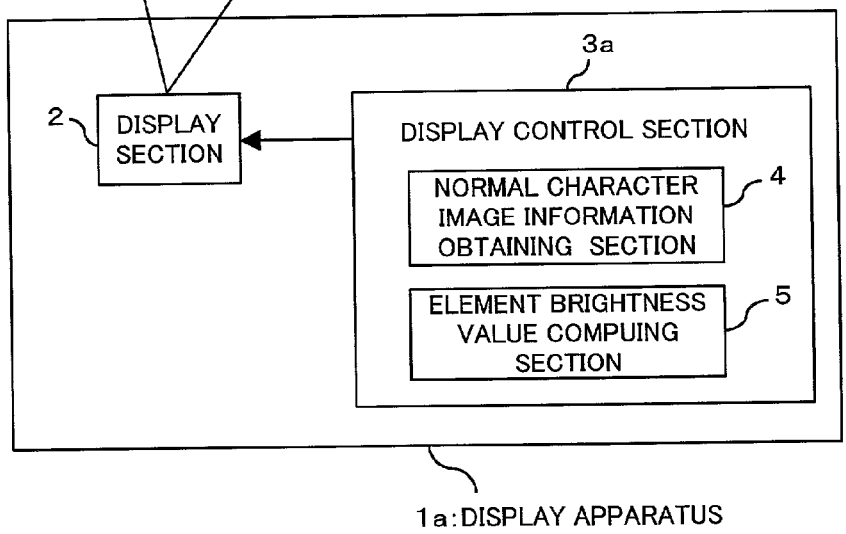
Figure 2:
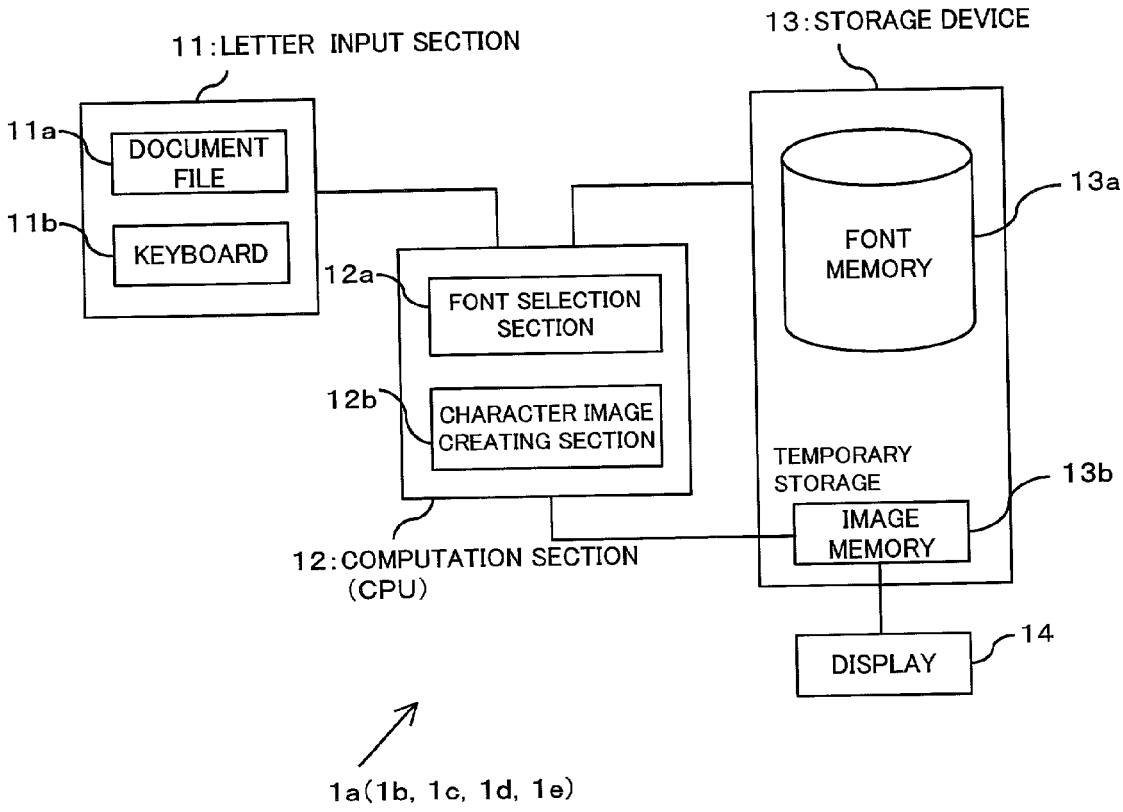
FIG. 2 is a block diagram showing the hardware configuration of the display apparatus of FIG. 1B.
Figure 3A:
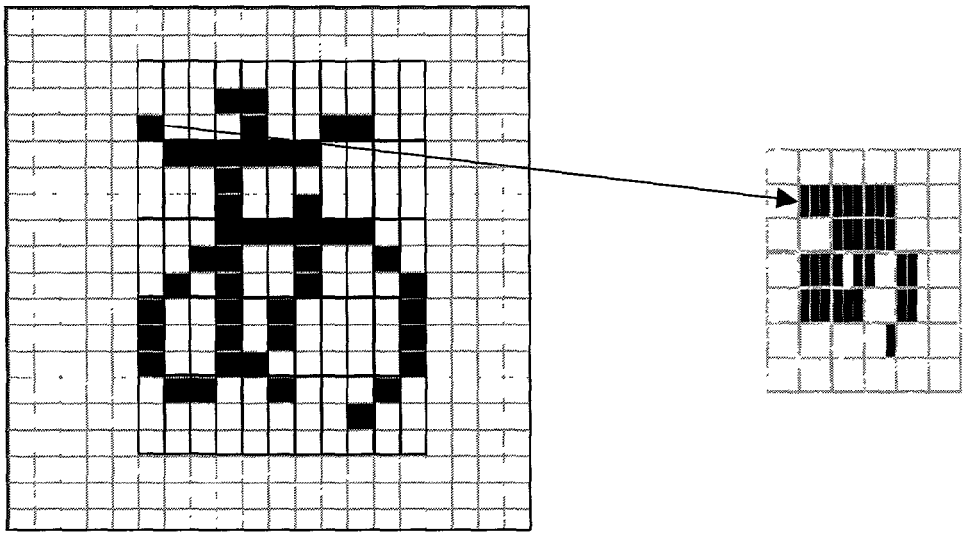
FIG. 3 shows a letter image to be prepared in comparison with a normal letter image to be used.
Figure 3B:
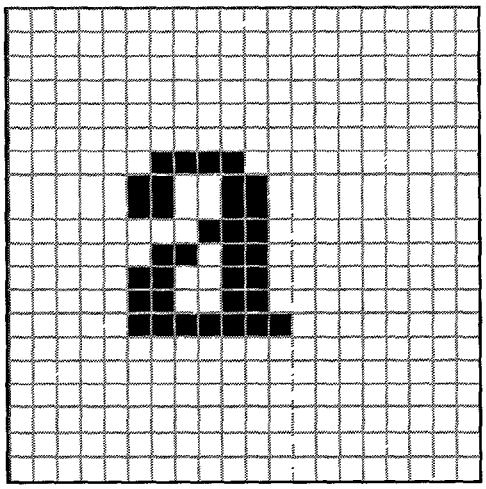
Figure 3B:
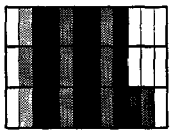
Figure 3C:
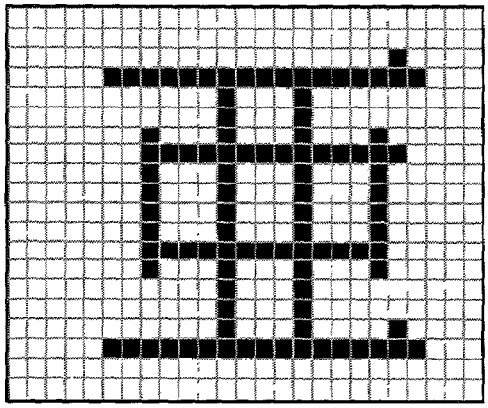
Figure 3C:
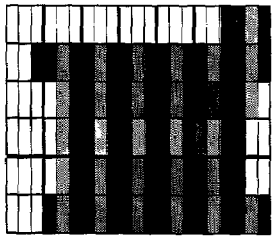

(A) Description of a First Embodiment:

FIGS. 1A, 1B, and 2 show a display apparatus according to a first embodiment of the present invention. FIG. 1A is an enlarged view of a display section of the display apparatus, and FIG. 1B is a block diagram showing a functional configuration of the display section. FIG. 2 is a block diagram showing the hardware configuration of the display apparatus of FIG. 1B.

A display apparatus 1*a* according to the first embodiment is provided in, e.g., a computer system. As shown in FIG. 1B, the display apparatus 1*a* is equipped with a display section 2 and a display control section 3*a*.

For example, the display section 2 is a color liquid-crystal display for displaying letter images of display objects. As shown in FIG. 1A, the display section 2 consists of a plurality of rectangular display elements (hereinafter simply called display elements) 10. In the display section 2, N rectangular elements 10 (three elements of R, G and B in the first embodiment; that is, N=3) are successively arranged in a predetermined layout direction (e.g., a horizontal direction in FIG. 1A) in such a manner that a longitudinal direction parallel to the longitudinal center line of the rectangular display elements 10 (e.g., a vertical direction in FIG. 1A) is perpendicular to the predetermined layout direction.

The display control section 3*a* controls the individual display elements 10 of the display section 2, thereby controlling a displaying state of the display section 2. For instance, in a case where the display section 2 is a transmission color liquid crystal display, the display control section 3*a* controls light-emitting state of respective display elements 10 constituting the color liquid-crystal display, thereby controlling a displaying state of the color liquid crystal display. In a case where the display section 2 corresponds to a reflective color liquid-crystal display, the display control section 3*a* controls light-reflecting state of the respective display elements 10, thus controlling a displaying status of the display section 2.

In the present invention, the display section 2 should by no means be limited to the liquid crystal display; the display section 2 may be embodied by means of being subjected to various modifications within the scope of the present invention.

Figure 4A:
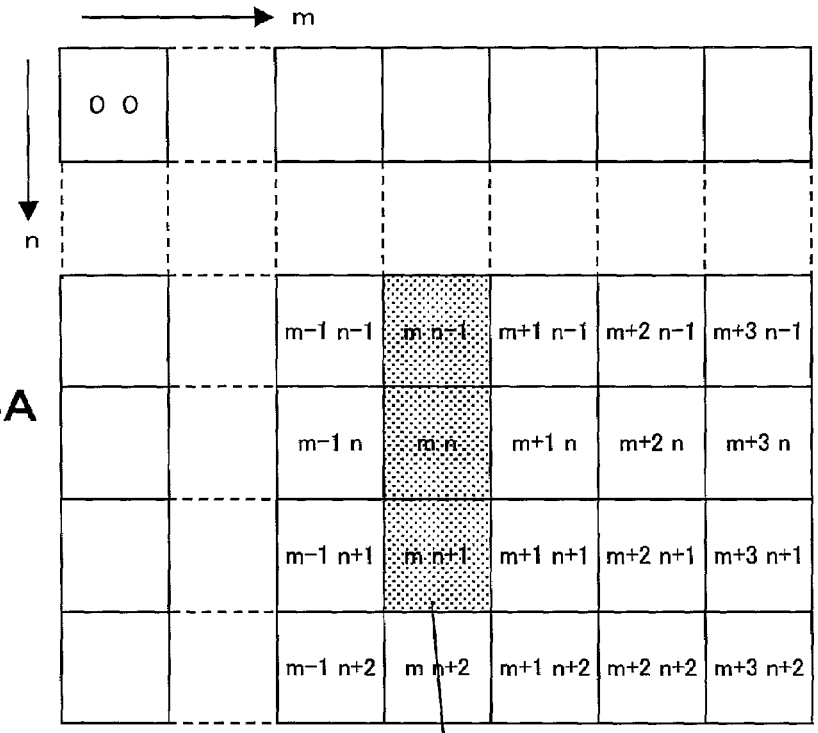
FIGS. 4A and 4B are illustrations for describing a coordinate conversion manner employed by the display apparatus of FIG. 1B.

The display control section 3*a* controls the display section 2 in such a manner that a display object is displayed with each of the N display elements 10 corresponding to one or more pixels (three pixels in the illustrated embodiment as shown in FIG. 4A) of the display object. Thereby, N display elements 10 display nine pixels of the display object.

The display control section 3*a* renders display section 2 to display the display object with N display elements, each corresponding M pixels (i.e., M=3 in the present embodiment) successively arranged in the longitudinal direction perpendicular to the predetermined layout direction so that the N display elements are represented by a group of pixels in an M×N matrix (in the illustrated example, a 3×3 matrix).

The display control section 3*a* is equipped with a normal letter image information obtaining section 4 and an element brightness value computing section 5.

The normal letter image information obtaining section 4 obtains normal letter image information for displaying a letter which is M times larger than the original size of the letter image in the longitudinal direction and N times larger than the original size in the predetermined layout direction with the N display elements 10 per pixel of the letter image in a normal display mode.

The element brightness value computing section 5 computes first brightness values (hereinafter a brightness value is also called a luminance) of the individual display elements 10, each corresponding to the M pixels successively arranged in the longitudinal direction, based on pixel values, provided one for each of the M pixels, of the normal letter image information obtained by the normal letter image obtaining section 4.

More specifically, the element brightness value computing section 5 computes an average of the pixel values provided to respective M pixels. On the basis of the thus-computed average, the element brightness value computing section 5 computes a first brightness value of corresponding rectangular display element 10.

In accordance with the first brightness value computed by the element brightness value computing section 5, the display control section 3*a* controls the rectangular display elements 10 in such a manner that the letter image is displayed in the original size on the display section 2.

FIG. 2 shows a more specific construction of the display apparatus 1*a* according to the first embodiment. As shown in FIG. 2, the display apparatus 1*a* is equipped with letter input section 11, computation section 12, a storage device 13, and a display 14.

Here, the display 14 corresponds to the display section 2 shown in FIG. 1B. As shown in FIG. 1A, the display 14 originally has a plurality of sets of three-color rectangular display elements (hereinafter simply called "display elements") 10, each of the display elements in an individual set being R (red), G (green), and B (blue) colors, respectively, in order to display a color image.

In the display 14, the rectangular display elements 10 are successively arranged in the predetermined layout direction (i.e., the horizontal direction in FIG. 1A; hereinafter called a "layout direction") in sequence of R, G, B, R, G, B . . . in such a manner that the longitudinal direction parallel to the longitudinal center lines of the rectangular display elements 10 (i.e., the vertical direction shown in FIG. 1A; hereinafter called a "longitudinal direction") is perpendicular to the layout direction. In other words, display elements 10 of the same color are arranged in the form of a column in the longitudinal direction on the display 14.

The display 14 displays a letter image loaded (stored) in the image memory 13*b*, and is controlled by the computation section 12.

The letter input section 11 enters a letter code for specifying a letter to be displayed on the display 14. For instance, the letter input section 11 is made of a document file 11*a* having letter code information recorded thereon and a keyboard 11*b*. The letter input section 11 is exemplified by a keyboard, a mouse, or a floppy disk drive unit in a computer system.

The storage device 13 includes a font memory 13*a* and the image memory 13*b*. The font memory 13*a* stores the normal letter image information and corresponds to a storage device, such as a hard disk drive or memory devices, in a computer system. The normal letter image information is letter image information to be used when the display apparatus 1*a* displays an individual pixel of the display object with three rectangular display elements 10. For instance, the normal letter information further includes font information containing a font size (or a letter image size of, e.g., point size 5), font types (e.g., Mincho or Gothic), and presence/absence of a serif (see FIG. 5). These contents of the font information are corresponding to the letter code for specifying an individual letter. The letter image information is stored in the font memory 13*a* in advance.

The image memory 13*b* temporarily stores (loads) the normal letter image information called from the font memory 13*a* and corresponds to a memory in a computer system.

The image memory 13*b* loads a letter image created (subjected to multiple-tone processing) by a letter image creating section 12*b*, which will be described later. The image memory 13*b* also serves as a multiple-tone memory.

In the present embodiment the image memory 13*b* serves to function also as a multiple-tone memory, the present invention should by no means be limited to such image memory 13*b*. Alternatively, the display apparatus 1*a* may also comprise multiple-tone memory in addition to the image memory 13*b*.

The computation section 12 performs various computation operations and corresponds to a CPU installed in a computer system. The computing section 12 also corresponds to the above-mentioned display control section 3*a*.

Further, the computation section 12 obtains the original size of a letter image to be displayed from the font memory 13*a* on the basis of the letter code entered from the letter input section 11. The computation section 12 includes a font selection section 12*a* and a letter image creating section 12*b*. In accordance with the inputted letter code entered, the font selection section 12*a*, corresponding to the above-mentioned normal letter image information acquisition section 4, calls a predetermined letter image (normal letter image information) from the font memory 13*a*.

The font selection section 12*a* acquires normal letter image information about a letter which is directed to be displayed by the letter input section 11. The acquired letter image information is used for displaying, in the normal display mode, the letter image of the display object in an enlarged size that is M times larger than the original size of the letter image in the longitudinal direction and N times larger than the original size in the layout direction. In the present embodiment, there will now be described the case assuming M=N=3.

In terms of a letter which the letter input means 11 has directed the display 14 to display, the font selection section 12*a* acquires information about an original size (e.g., point size 5) of the letter image with reference to a letter code. The font selection section 12*a* acquires, from the font memory 13*a*, letter image information about an identical latter of which the original size is scaled up three times in both the longitudinal direction and layout direction (i.e., a 15-point letter). The thus-acquired letter image is loaded in the image memory 13*b*.

The letter image generation section 12*b* creates a letter image to be displayed on the display 14. In order to cause the display 14 to display the letter image acquired by the font selection section 12*a*, the letter image creating section 12*b* computes first brightness values of the respective display elements 10 of the display 14.

The letter image creating section 12*b* makes the display 14 display a letter in a high-resolution display mode. The letter image (i.e., normal letter image information) three times larger than the original size to be displayed, which size is acquired by the font selection section 12*a* is loaded in the image memory 13*b*. Subsequently, the element brightness value computing section 5 computes first brightness values of individual (rectangular) display elements 10, each corresponding to three pixels successively arranged in the longitudinal direction, based on pixel values, provided one for each of the three pixels, of the normal letter image information obtained by the font selection section 12*a*.

The letter image creating section 12*b* relates each of the display elements 10 with three pixels successively arranged in the longitudinal direction perpendicular to the layout direction so that three display elements 10 are represented by a group of 3×3 matrix.

Figure 4B:
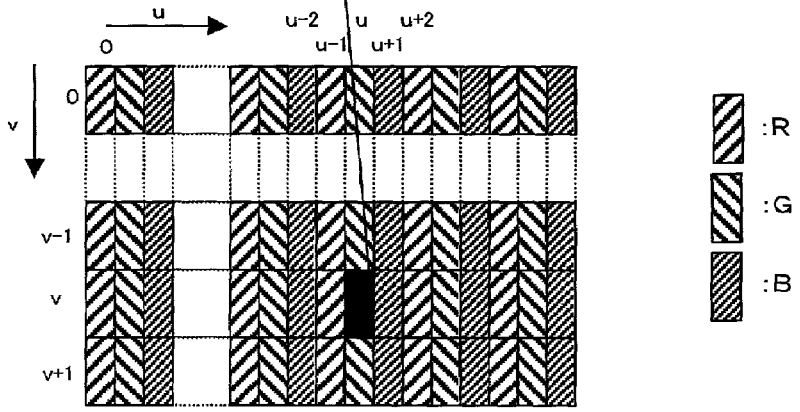

With reference to FIGS. 3 (i.e., FIGS. 3A, 3B and 3C), 4A, 4B, there will now be described a control manner by which the letter image creating section 12*b* causes the display 14 to display a letter of a display object. FIGS. 3, 4A, 4B illustrate a control manner performed when the letter image creating section 12*b* displays a letter image. FIG. 3 shows a comparison of a letter image to be created and a normal letter image to be used. FIGS. 4A and 4B illustrates a coordinate conversion manner executed by the display apparatus 1*a* according to the first embodiment: FIG. 4A shows coordinates of each of the pixels constituting the letter image; and FIG. 4B shows coordinates of a display of each of the display elements 10.

As shown in FIG. 3, the font selection section 12*a* calls, from the font memory 13*a*, a letter image having a computed size; that is, a letter which is scaled up three times the original size of the letter image to be displayed. The thus-called letter image is temporarily stored in the image memory 13*b*. In succession, the letter image creating section 12*b* performs a coordinate conversion and computation of brightness values of the respective R-G-B display elements 10 so as to display the letter image stored in the image memory 13*b* with the display elements 10.

Here, with reference to FIGS. 4A and 4B, there will now be described a process of the letter image creating section 12 causing the display elements 10 to display the letter image of a display object in more detail.

The letter image creating section 12*b* obtains an average of pixel value of the three pixels arranged in the longitudinal direction parallel to the longitudinal center line of the R, G, B display elements 10.

For instance, in a matrix of FIG. 4A, it is assumed that a pixel value of the pixel located at coordinates (m, n−1) is $P_{mn-1}$; a pixel value of the pixel located at coordinates (m, n) is $P_{mn}$; and a pixel value of the pixel located at coordinates (m, n+1) is $P_{mn+1}$. An average P' of the three pixel values is computed by the following equation.

$$P'=(P_{mn-1}+P_{mn}+P_{mn+1})/3$$

Here, an average P' of three pixels corresponding the red (R) display element 10 is represented by $P'_R$ by being given a suffix "$_R$" to P'. Similarly, averages of the three pixel values corresponding to the G display element 10 and the B display element 10 are represented by "$P'_G$" and "$P'_B$", respectively.

The letter image creating section 12*b* relates the averages P' of the three pixels (see FIG. 4A) to the individual corresponding display elements 10 (see FIG. 4B) so that the averages P' is converted into coordinates of the individual corresponding display elements 10 (this conversion is hereinafter called a "coordinate conversion arithmetic operation").

For example, as shown in FIGS. 4A and 4B, the three pixels located at the respective coordinates (m, n−1), (m, n), and (m, n+1) are displayed with a single G display element located at (u, v).

Subsequently, the letter image creating section 12*b* determines a first brightness value $Q_G$ of a G display element 10 located at (u, v) according to the following equation.

$$Q_G(u, v)=F_G(P'_G)$$

where, u=m, and v=(n−1)/3. F denotes a function to be used for converting a brightness value; for instance, F is expressed by a linear function, such as $F(x)=\alpha x+\beta$, where $\beta$ is an offset, and $\alpha$ denotes an amplification factor.

Similarly, a brightness value of an R display element 10 is computed according to the following equation:

$$Q_R(u, v)=F_R(P'_R)$$

Further, a brightness value of a B display element 10 is computed according to the following equation:

$$Q_B(u, v)=F_B(P'_B)$$

In the embodiments shown in FIGS. 4A and 4B, the three pixels located at the respective coordinates (m, n−1), (m, n), and (m, n+1) are displayed through use of the G display element located at (u, v). However, the present embodiment should by no means be limited to such an arrangement or coordinates of pixels.

Alternatively, three pixels located at the respective coordinates (m, n−2), (m, n−1), and (m, n) may be displayed with the G display element located at (u, v). As a further alternative, three pixels located at the respective coordinates (m, n), (m, n+1), and (m, n+2) may be displayed through use of the G display element located at (u, v). Moreover, these pixels may be displayed by an R display element 10 located at (u−1, v) or a B display element 10 located at (u+1, v). Thus, the present invention can be implemented in the form of various modifications within the scope of the invention.

As mentioned above, the letter image creating section 12*b* (i.e., the element brightness value computing section 5) computes first brightness values of the respective display elements 10. In accordance with the computed brightness values, the computation section 12 (the display control section 3*a*) controls the respective display elements 10, whereby letters constituting the letter image is displayed on the display 14.

Figure 5:
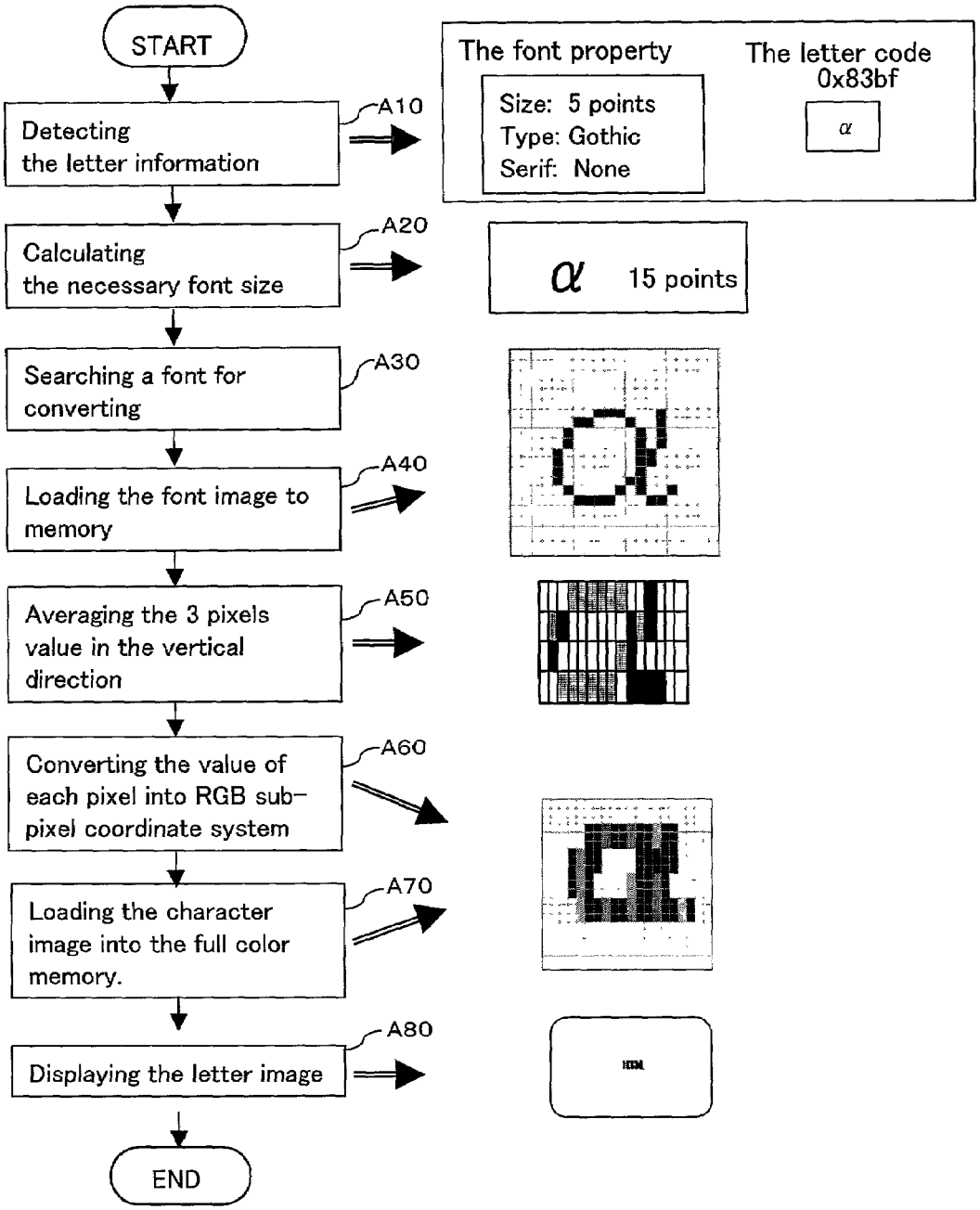
FIG. 5 is a flowchart for describing a computing process to be performed by computation section of the display apparatus of FIG. 1B.

A process to be performed by the computation section 12 (the display control section 3*a*) in the display apparatus 1*a* according to the first embodiment having the above-described construction will now be described with reference to a flowchart of in FIG. 5 (steps A10 to A80).

When a letter code for specifying a letter to be displayed is entered from the letter input section 11 (step A10), the font selection section 12*a* acquires size information about the original size of the letter on the basis of the entered letter code.

The font selection section 12*a* calculates a size (e.g., point size 15) which is scaled up three times, in both the longitudinal direction and layout direction, the original size (e.g., point size 5) of the letter image to be displayed (step A20). An identical letter image having the calculated size is called by searching in the font memory 13*a* (step A30), whereupon the called letter image is loaded in the image memory 13*b* (step A40).

Next, the letter image creating section 12*b* calculates an average of each pixel sequence of three pixels successively arranged in the longitudinal direction (i.e., performs normalization of a pixel sequence) (step A50). The each of the pixels constitutes the letter image loaded in the image memory 13*b*. The letter image creating section 12*b* applies the averages of the three pixels to the corresponding display elements 10 to convert the coordinates of the respective pixels into the coordinates of respective R-G-B display elements 10 (step A60).

The letter image creating section 12*b* computes the first brightness values of the respective display elements 10 and loads the computed brightness values into multiple-tone (full-color) memory (the image memory 13*b*) (step A70).

The computation section 12 (the display control section 3*a*) controls the respective display elements 10 in the light-emitting state in accordance with the first brightness values loaded of the image memory 13*b* so as to display the letter in the letter image (step A8).

In the display apparatus 1*a*, the display control section 3*a* renders the display 14 to display the letter image with the display elements 10, each corresponding to three pixels, so that the display elements 10 are represented by a group of pixels in a 3×3 matrix. As a result, since three display elements 10 corresponds a plurality of pixels when the letter image is displayed, it is possible for the display 14 (or the display section 2) to display a letter image in a higher resolution.

When the display object is a letter image, the display control section 3*a* comprises the normal letter image information obtaining section 4 that obtains normal letter image information for displaying a letter image which is three times larger than the original size of the letter image in a longitudinal direction and three times larger than the original size in the layout direction with the three display elements corresponding to each of the pixels of the letter image; and the element brightness value computing section 5 that computing the first brightness value of the individual rectangular display elements 10, each corresponding to the three pixels successively arranged in the longitudinal direction, based on the pixel values, provided one for each of the three pixels, of the normal letter image information. With the normal letter image information obtaining section 4 and the element brightness value computing section 5, the display control section 3*a* varies the color factors of the display elements 10 in accordance with the first brightness values in such a manner that the display section 2 display the letter image in the original size. Therefore, it is possible to display a letter image in a high resolution.

The element brightness value computing section 5 computes an average of pixel values of three pixels. On the basis of the computed average, the first brightness value of a single rectangular display element 10 is computed thereby computing the brightness value of a rectangular display element 10 with ease.

Figure 6A:
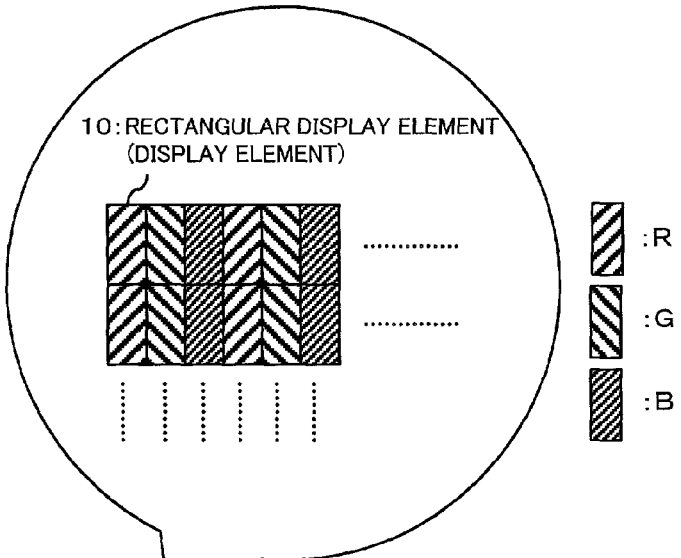
Figure 6B:
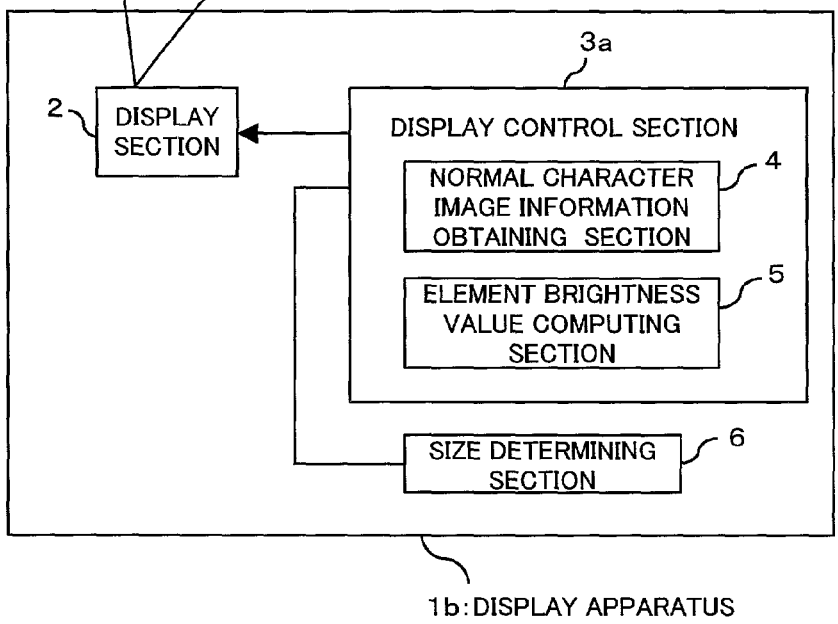

(B) Description of Modification of the First Embodiment:

FIGS. 6A and 6B are illustrations for describing a modification of the display apparatus 1*a* of the first embodiment. FIG. 6A is an enlarged view of the display section 2; and FIG. 6B is a block diagram showing the functional construction of the display section 2.

As shown in FIGS. 6A and 6B, a display apparatus 1*b* serving as a modification of the first embodiment is provided in a computer system equipped with, e.g., a color liquid crystal display, as in the case of the display apparatus 1*a* according to the first embodiment. As shown in FIG. 6B, the display apparatus 1*b* is equipped with the display section 2, the display control section 3*a*, and a size determining section 6.

In these drawings, those reference numbers identical with those described previously designate identical or substantially identical elements or parts, and hence repetitious explanations thereof are omitted. The display apparatus 1*b* according to the present modification is identical in hardware configuration with the display apparatus 1*a* shown in FIG. 2, and detailed explanations thereof are also omitted.

As in the case of the display apparatus 1*a* shown in FIGS. 1A and 1B, the display apparatus 1*b* according to the modification is constructed such that three display elements 10 emit light in respective different colors. More specifically, the display apparatus 1*b* is equipped with the display 14 (the display section 2) formed from sets of three rectangular display elements (hereinafter simply called "display elements") which emit light in R (red), G (green), and B (blue), respectively.

In the display section 2, N rectangular elements 10 (e.g., N corresponds to three R-G-B elements in the present modification; that is, N is three) are successively arranged in a predetermined layout direction (e.g., a horizontal direction in FIG. 6A) perpendicular to the longitudinal center lines of the rectangular display elements 10 (e.g., a vertical direction in FIG. 6A; hereinafter also called the longitudinal direction) in such a manner that the three display elements correspond one pixel in the normal color display mode.

The size determining section 6 determines whether or not the original size of a letter to be displayed on the display section 2 is equal to or smaller than a predetermined standard size. When it is determined that the letter is equal to or smaller than the standard size, the display control section 3*b* is notified that the letter is equal to or smaller than the standard size.

The display control section 3*a* controls the displaying state of the display section 2 in terms of color factors of the individual display elements 10 in the display section 2. The display control section 3*a* performs the normal display mode and the high-resolution display mode. In the normal display mode, the display object is displayed with N display elements per pixel. In a high-resolution display mode, the display object is displayed with each of the display elements 10 corresponding to one or more pixels (three pixels in the present modification as shown in FIGS. 4A, 4B) whereby the N display elements 10 corresponds to a plurality of pixels (nine pixels in the illustrated modification).

When it is determined by the size determining section 6 that the original size of the letter to be displayed on the display section 2 is equal to or smaller than the standard size, the display control section 3*a* makes the display section 2 display the letter with N display elements 10 in the group of an M×N matrix (3×3 in the illustrated modification) (hereinafter called the "high-resolution display mode"), as mentioned previously.

The display apparatus 1*b* sets in advance, by way of the keyboard 11*b* or a non-illustrated mouse, a standard original letter size used as a threshold value upon a display in the high-resolution display mode.

In the display apparatus 1*b*, the computation section 12 acquires, from the font memory 13*a*, a original size of a letter image to be displayed based on the letter code entered from the letter input section 11. The letter size is compared with the predetermined standard size to determine whether or not the letter is equal to or smaller than the standard size.

In the display apparatus 1*b* according to the modification, the computation section 12 functions as the size determining section 6. With such a function, when the letter size is equal to or smaller than the standard size, the letter is displayed in the high-resolution display mode.

In the display apparatus 1*b*, when the display 14 displays a letter image in the normal display mode, the font selection section 12*a* acquires information about the original size (e.g., point size 5) of the letter, which the letter input section 11 directs to display on the display section 2, based on its letter code. After that, the font selection section 12*a* acquires letter image information about the identical letter identical in size with the letter in the letter image information from the font memory 13*a*.

When a letter image is displayed on the display 14 in a high-resolution mode, the font selection section 12*a* acquires letter size information of the original size (e.g., point size 5) of the letter, which the letter input section 11 directs to display on the display section 2, based on the letter code. After that, the font selection section 12*a* acquires, from the font memory 13*a*, letter image information about an identical letter, whose size is scaled up three times in the longitudinal direction and the layout direction (i.e., a 15-point letter), with the letter image. The acquired letter image is loaded in the image memory 13*b*.

When a letter is displayed on the display 14 in the normal display mode, the letter image creating section 12 computes first brightness values of respective display elements 10 using a plurality of pixels of the letter image loaded in the image memory 13*b* in such a manner that the letter image is displayed with sets of three R-G-B display elements 10, which are successively arranged in the layout direction, corresponding to one pixel.

In the normal display mode, the letter image creating section 12*b* display the letter image with three display elements per pixel.

In a case where a letter is displayed in the high-resolution display mode, the letter image creating section 12*b* loads, in the image memory 13*b*, the letter image (normal letter image information) which is scaled up three times the original size of the letter that is to be displayed, which the letter image has been acquired by the font selection section 12*a*. The element brightness value computing section 5 computes first brightness values of the individual display elements corresponding to three pixels, successively arranged in the longitudinal direction, based on the pixel values, one provided for the each pixel of the normal letter image information obtained from the font selection section 12*a* (the normal letter image information acquisition section 4).

The letter image creating section 12*b* relates each of the display elements 10 with three pixels successively arranged in the longitudinal direction perpendicular to the layout direction so that three display elements 10 are represented by a group of pixels of a 3×3 matrix.

Figure 7A:
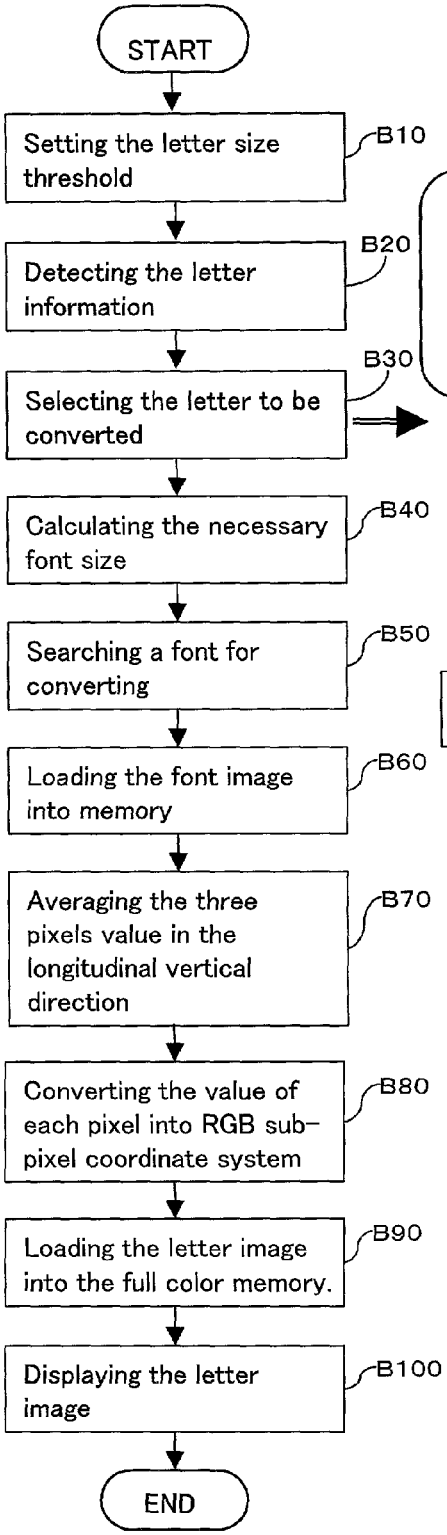
FIG. 7A is a flowchart showing a control method to be used when a size determining section employed in the modification of the display apparatus according to the first embodiment, upon determining of the size of a certain letter image and displays the letter image in a high-resolution display mode.

With reference to a flowchart (steps B10 to B100) shown in FIG. 7A, there will now be described a control manner, in which the size determining section 6 of the display apparatus 1*b* determines the original size of a letter image to be displayed to execute a high-resolution display mode based on result of the determining.

The computation section 12 sets a threshold value for performing a display in a high-resolution mode, through use of the keyboard 11*b* or a non-illustrated mouse (step B10).

When letter codes for specifying a letter to be displayed is entered from the letter input section 11 (step B20), the computation section 12 selects the letter to be displayed in a high-resolution mode among letter images to be displayed (step B30).

More specifically, the computation section 12 acquires size information about the original size of the letter from letter image information and compares the original letter size with the threshold value. The computation section 12 selects a letter image smaller in size than the threshold value for a future display of the thus-selected letter image in the high-resolution display mode.

Figure 7B:
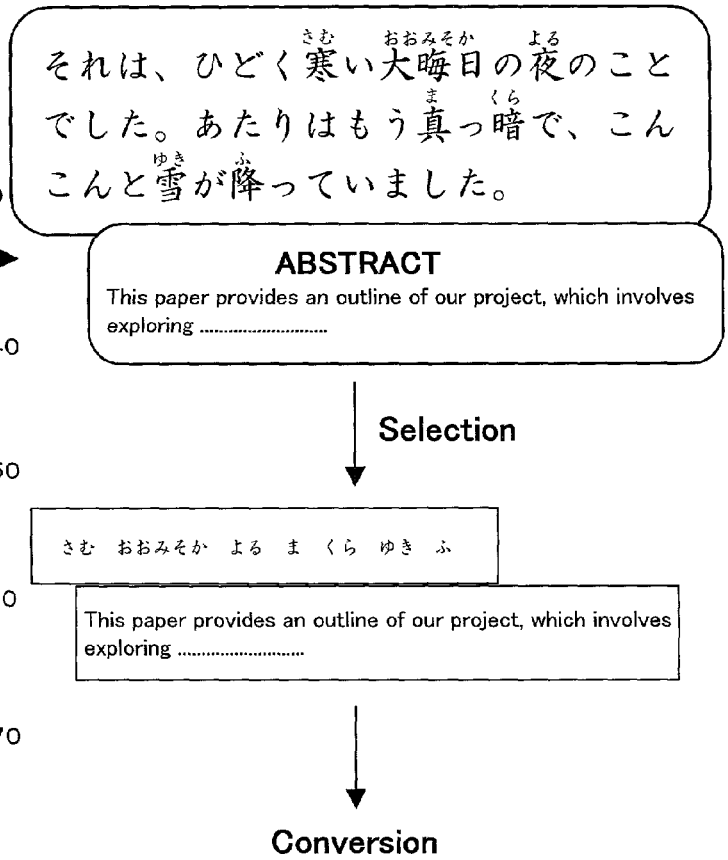
FIG. 7B shows contents of a document.

For instance, FIG. 7B shows contents of a document. As shown in FIG. 7B, letter images constituting Japanese kana letters on kanjis (Chinese Characters) in the contents are selected for a future display in the high-resolution display mode.

On the basis of the input letter code, the font selection section 12*a* acquires information about the font size of the letter to be displayed in the high-resolution display mode.

The font selection section 12*a* calculates a letter size (i.e., a 15-point letter) scaled up three times, in both the longitudinal direction and layout direction, the original size of the letter (step B40). Further, the font selection section 12*a* calls, from the font memory 13*a*, an identical letter image identical in size with the thus-computed size (step B50) to load in the image memory 13*b* (step B60).

Next, the letter image creating section 12*b* computes an average (normalizes) of three pixels;, successively arranged in the longitudinal direction, with respect to each of the pixels constituting the letter image loaded in the image memory 13*b* (step B70). The letter image creating section 12*b* converts the coordinates of the respective pixels into the coordinates of respective R, G, B display elements 10 by using the computed averages of the three pixels corresponding to the respective R-G-B display elements 10 (step B80).

After that, the letter image crating section 12*b* computes the first brightness values of the respective display elements 10 and loads the thus-computed first brightness values into multiple-tone (full-color) memory (the image memory 13*b*) (step B90).

The computation means 12 (i.e., the display control section 3*a*) controls the light-emitting state of the respective display elements 10 in accordance with the first brightness values stored in the image memory 13*b*, whereby the letter of the letter images is displayed on the display 14 (step B100).

The display apparatus 1*b* serving as a modification of the first embodiment of the present invention can guarantee the same working effects and advantages as those of the display apparatus 1*a* described in the first embodiment. Further, the display control section 3*a* render the display section 2 display in the normal display mode and the high-resolution display mode. In the normal display mode, a display object is displayed with three display elements 10 corresponding to one pixel. In the high-resolution display mode, a display object is displayed with the respective display element 10 corresponding to three pixels so that three display elements 10 are represented by a group of nine pixels of a 3×3 matrix. In the high-resolution display mode, a display corresponding to a plurality of pixels can be provided through use of three display elements 10. As a result, the display 14 (or the display section 2) can display a letter image of higher resolution.

The display apparatus 1*b* further includes the size determining section 6 which determines whether or not a letter is equal to or smaller in size than a predetermined standard size. If the size determining section 6 has determined that the letter is equal to or smaller than the standard size, the display control section 3*a* makes the display 14 display in a high-resolution display mode. Since a letter larger than a standard size is displayed in a normal display mode, display control is easy, thereby accelerating processing. In contrast, if a letter to be displayed is equal to or smaller than the standard size, the letter is displayed in a high-resolution display mode. Thus, even when a letter smaller than the standard size is displayed on the display 14, it is possible to serve the letter in a high resolution.

(C) Description of a Second Embodiment

Figure 8A:
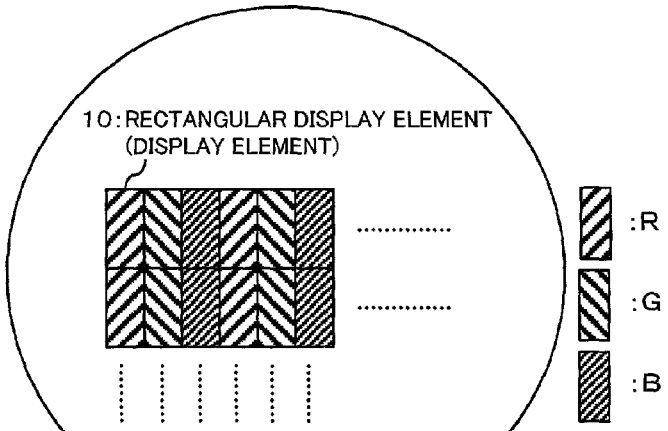
Figure 8B:
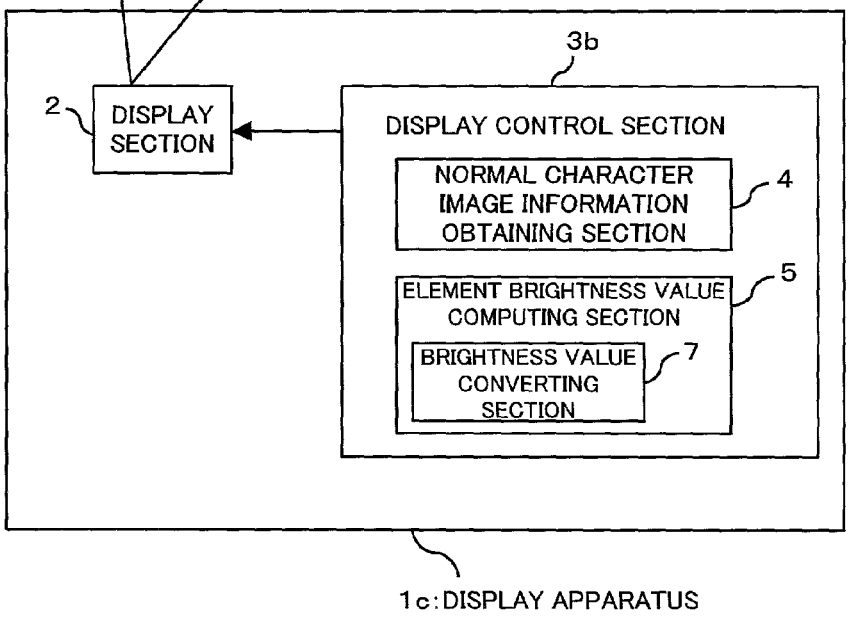

FIGS. 8A and 8B are drawings for describing a display apparatus according to a second embodiment of the present invention. FIG. 8A is an enlarged view showing a display section of the display apparatus, and FIG. 8B is a block diagram showing the functional construction of the display section.

As shown in FIGS. 8A and 8B, a display apparatus 1*c* according to the second embodiment is provided in a computer system equipped with, e.g., a color liquid-crystal display, as in the case of the display apparatus 1*a* according to the first embodiment. In the display apparatus 1*c*, a brightness value conversion section 7, as shown in FIG. 8B, is additionally included in the element brightness value computing section 5 of the display apparatus shown in FIG. 1B.

In these drawings, those reference numbers identical with those described previously designate identical or substantially identical elements or parts, and hence repeated explanations thereof are omitted. The display apparatus 1*c* according to the second embodiment is identical in hardware configuration with the display apparatus 1*a* (or 1*b*) shown in FIG. 2, and detailed explanations thereof are also omitted.

As in the case of the display apparatus 1*a* shown in FIGS. 1A and 1B, the display apparatus 1*c* according to the present embodiment is constructed such that three display elements 10 emit light in respective different colors. More specifically, the display apparatus 1*c* is equipped with the display 14 (i.e., the display section 2) formed from sets of three rectangular display elements (hereinafter simply called "display elements") which emit light in R (red), G (green), and B (blue).

In the display control section 3*b* of the display apparatus 1*c*, the element brightness value computing section 5 includes the brightness value converting section 7. The brightness value computing section 5 executes a conversion process simultaneously with computation of a first brightness value.

The brightness value converting section 7 converts first brightness values of respective display elements 10 into second brightness values in accordance with lightness characteristics of the respective display elements 10 in such a manner that the R-G-B display elements 10 are identical in lightness.

The brightness value converting section 7 is realized by a letter image creating section 12*b* shown in FIG. 2.

Here, a conversion operation to be performed by the brightness value converting section 7 (hereinafter called a "lightness stabilization-and-conversion processing") will now be described by reference to drawings.

First of all, the letter image creating section 12*b* of the display apparatus 1*a* of the first embodiment, the brightness value converting section 7 loads the letter image, which has been acquired by the font selection section 12*a* and which has been scaled up three times the original size of the letter image to be displayed (i.e., normal letter image information). Subsequently, the letter image creating section 12*b* computes first brightness values ($Q_R$, $Q_G$, $Q_B$) of the respective R-G-B display element 10, each corresponding to a set of three pixels successively arranged in the longitudinal direction based on the pixel values, one provided for each pixel, of the letter image loaded in the image memory 13*b*.

If the R-G-B display elements 10 are identical in brightness value as a result of the computation of the first brightness values ($Q_R$, $Q_G$, $Q_B$) of the display elements 10, the brightness value converting section 7 performs a process represented by the following equation with respect to the computed first brightness values in such a manner that the respective R-G-B display elements 10 emit light identical in lightness. Here, provided that the first brightness values computed from the pixel values of the letter image are $Q_R$, $Q_G$, and $Q_B$, respectively, second brightness values $Q_R$brightness, $Q_G$brightness, and $Q_B$brightness, which have been converted so as to achieve an identical lightness (the conversion will be hereinafter called "lightness halftoning operation"), are computed according to the following equations:

$$Q_R\text{brightness}=Fb(0.60Q_R)$$

$$Q_G\text{brightness}=Fb(0.384Q_G)$$

$$Q_B\text{brightness}=Fb(1.0Q_B)$$

Here, Fb is a function for realizing an identical lightness and is expressed as a linear function, such as $Fb(x)=\alpha'x+\beta'$. $\beta'$ is an offset value and is set such that the R-G-B display elements 10 are identical in lightness. Further, $\alpha'$ is expressed by the following equation.

$\alpha'$=(the total number of tones of brightness in lightness half tone−an offset value)/the total number of brightness instruction values Here, assuming that a lightness value is L; a Y stimulus value of an XYZ color system is Y; a tristimulus value of a standard light source or of standard light of illumination is $Y_0$; and tristimulus values on a monitor are R', G', and B', the following formulae stand between the lightness value L and first brightness values $Q_R$, $Q_G$, and $Q_B$ of the respective display elements 10.

$$L^*=116(Y/Y_0)\cdot\tfrac{1}{3}-16$$

$$Y=aR+bG+cB$$

$$Y_0=1.0$$

$$Q_R\text{brightness}=(d(Q_R+e))^{2.4}$$

$$Q_G\text{brightness}=(d(Q_G+e))^{2.4}$$

$$Q_B\text{brightness}=(d(Q_B+e))^{2.4}$$

where, "a" through "e" are constants.

Here, provided that a:b:c=0.2126:0.7152:0.0722 is defined on the basis of sR-G-B (International Standard IEC61966-2-1), the following ratio is obtained with respect to the second brightness values when first brightness values are identical (i.e., $Q_R=Q_G=Q_B$).

$Q_R$brightness:$Q_G$brightness:$Q_B$brightness=0.600:0.384:1.000

The ratio among the three second brightness value allows a tolerance value of approximately 0.100.

As a result, there can be obtained $Q_R$brightness:$Q_G$brightness:$Q_B$brightness=0.600±0.100:0.384±0.100:1.000±0.100.

In the display apparatus 1*c* of the second embodiment, the brightness value converting section 7 performs the conversion process such that the ratio among the second brightness values after the conversion process becomes 0.600±0.100:0.384±0.100:1.00±0.100, if the three display elements 10 (that is, an R display element 10, a G display element 10, and a B display element 10) are identical in first brightness value.

FIG. 9A shows a table of second brightness values, wherein the R-G-B display elements 10 are identical in lightness when the R-G-B display elements 10 emit light in accordance with identical first brightness values. In this example, the total number of tones is 256. FIG. 9B is a table showing a case where (R, G, B)=(6, 4, 10) is set as an offset value.

For example, in FIG. 9A, when the first brightness values of the R-G-B display elements 10 computed by the element brightness value computing section 5 are identical in first brightness value of 100 (i.e., ($Q_R$, $Q_G$, $Q_B$)=(100, 100, 100)), the first brightness values are converted into ($Q_R$brightness, $Q_G$brightness, $Q_B$brightness)=(60, 38, 100) in order that the R-G-B display elements 10 are identical in lightness.

Figure 10:
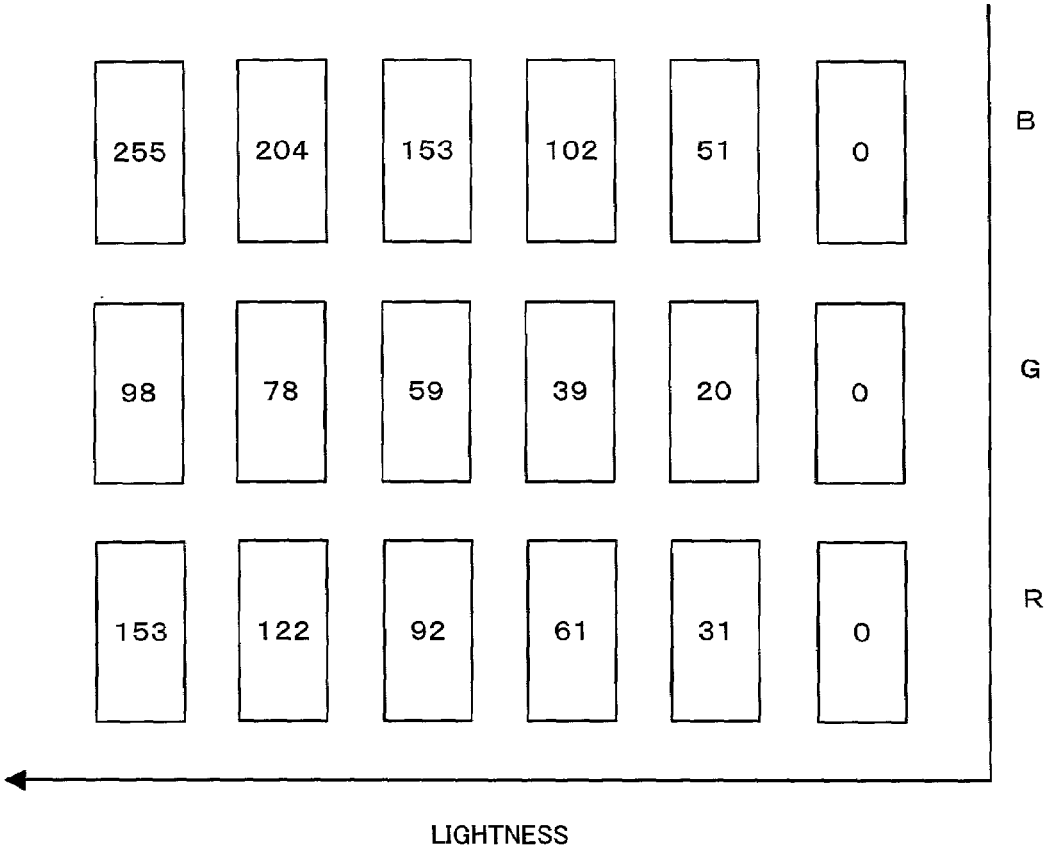
FIG. 10 is a diagram showing an example of tones of certain lightness to be affected by the display apparatus according to the second embodiment of the present invention.

FIG. 10 is a diagram showing an example of tones of a particular lightness to be effected by the display apparatus 1*c* according to the second embodiment of the present invention. More specifically, the diagram shows brightness at which the R color, the G color, and the B color are identical in lightness when a tone value of 0 is assumed as a reference and lightness is classified into six levels of tone. In FIG. 10, when the R, G, B display elements 10 respectively have brightness values arranged in the vertical direction, the three display elements 10 are identical in lightness. Namely, the lightness of the R, G, B display elements 10 is proportional to a tone step, and the R-G-B display elements 10 at the same tone level are identical in lightness.

The lightness of green (G) varies over the widest range in accordance with the brightness of RGB colors, whereas the lightness of blue B varies over the narrowest range in accordance with the brightness of RGB colors. Hence, when halftoning is carried out while lightness is assumed as a reference, the ranges of lightness variation pertaining to other two colors (i.e., red and green) must be aligned to the narrowest range of lightness variation pertaining to a blue color. Here, assuming that the number of steps of tone pertaining to blue is 256 (0 through 255), the number of steps of tone pertaining to green can be set up to a natural number within a value of (256×0.384/1.00).

Figure 11:
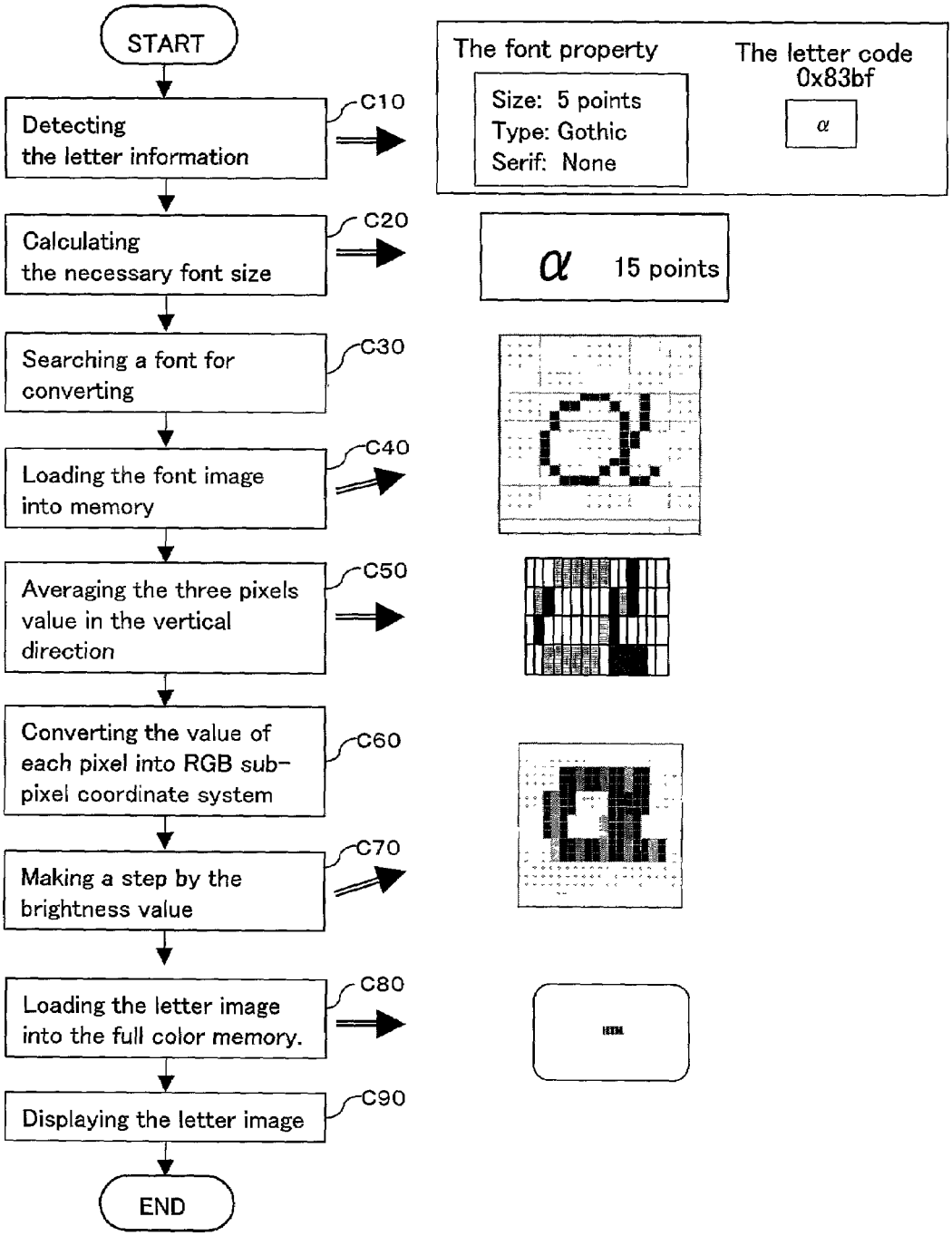
FIG. 11 is a flowchart for describing processing to be performed by computation means in a high-resolution mode of the display apparatus according to the second embodiment.

A process to be performed by the computation section 12 (i.e., the display control section 3*b*) of the display apparatus 1*c* having the foregoing construction according to the second embodiment will now be described with reference to a flowchart (steps C10 to C90) of FIG. 11.

When a letter code for specifying a letter to be displayed is entered by way of the letter input section 11 (step C10), on the basis of the entered letter code the font selection section 12*a* acquires font size information about the original size of the letter.

The font selection section 12*a* calculates a size (e.g., point size 15) which is scaled up three times, in both the longitudinal direction and the layout direction, the original size (e.g., point size 5) of the letter image to be displayed (step C20). An identical letter image having the scaled-up size is searched in the font memory 13*a* to be called (step C30), and the called letter image is loaded in the image memory 13*b* (step C40).

In succession, the letter image creating section 12*b* computes an average of pixel values of each pixel sequence consisting of three pixels successively arranged in the longitudinal direction (i.e., performs normalization of a pixel sequence), which pixels constitute the letter image loaded in the image memory 13*b* (step C50). The letter image creating section 12*b* converts the coordinates of the respective pixels into the coordinates of respective R-G-B display elements 10 using the computed averages of each set of three pixels corresponding to the respective display elements (step C60).

Subsequently, the letter image creating section 12*b* computes the first brightness values of the respective display elements 10 and, when the R-G-B display elements 10 emit light in accordance with an identical brightness value, executes lightness halftoning operation in such a manner that the display elements 10 are identical in lightness (step C70).

The letter image creating section 12*b* loads the computed second brightness values having undergone lightness halftoning operation into multiple-tone (full-color) memory (i.e., the image memory 13*b*) (step C80).

The computation section 12 (i.e., the display control section 3*b*) controls the light-emitting states of the respective display elements 10 in accordance with the second brightness values loaded in the image memory 13*b*, whereby the letter constituting the letter image is displayed on the display 14 (step C90).

As mentioned above, the display apparatus 1*c* according to the second embodiment guarantees the same working effects and advantages as those of the display apparatus 1*a* of the first embodiment. Since the brightness value converting section 7 converts the first brightness values of the respective display elements 10 into the second brightness values in accordance with the lightness characteristics of the respective display elements 10 in such a manner that the three display elements 10 are identical in lightness when the elements 10 emit light in accordance with an identical brightness value, it is possible for the display elements 10 to have an identical lightness and it is further possible to uniformly display the letter image of an display object on the display 14, improving the quality of the displayed letter.

Since the element brightness value computing section 5 also serves as the brightness value conversion section 7 and performs the converting on the first brightness value to the second brightness value simultaneously with the computing of the first brightness value, process in the display apparatus 1*c* can be executed promptly and hardware configuration of the display device 1*c* can be simplified. As a result, manufacturing costs for the display apparatus can be diminished.

Figure 12:
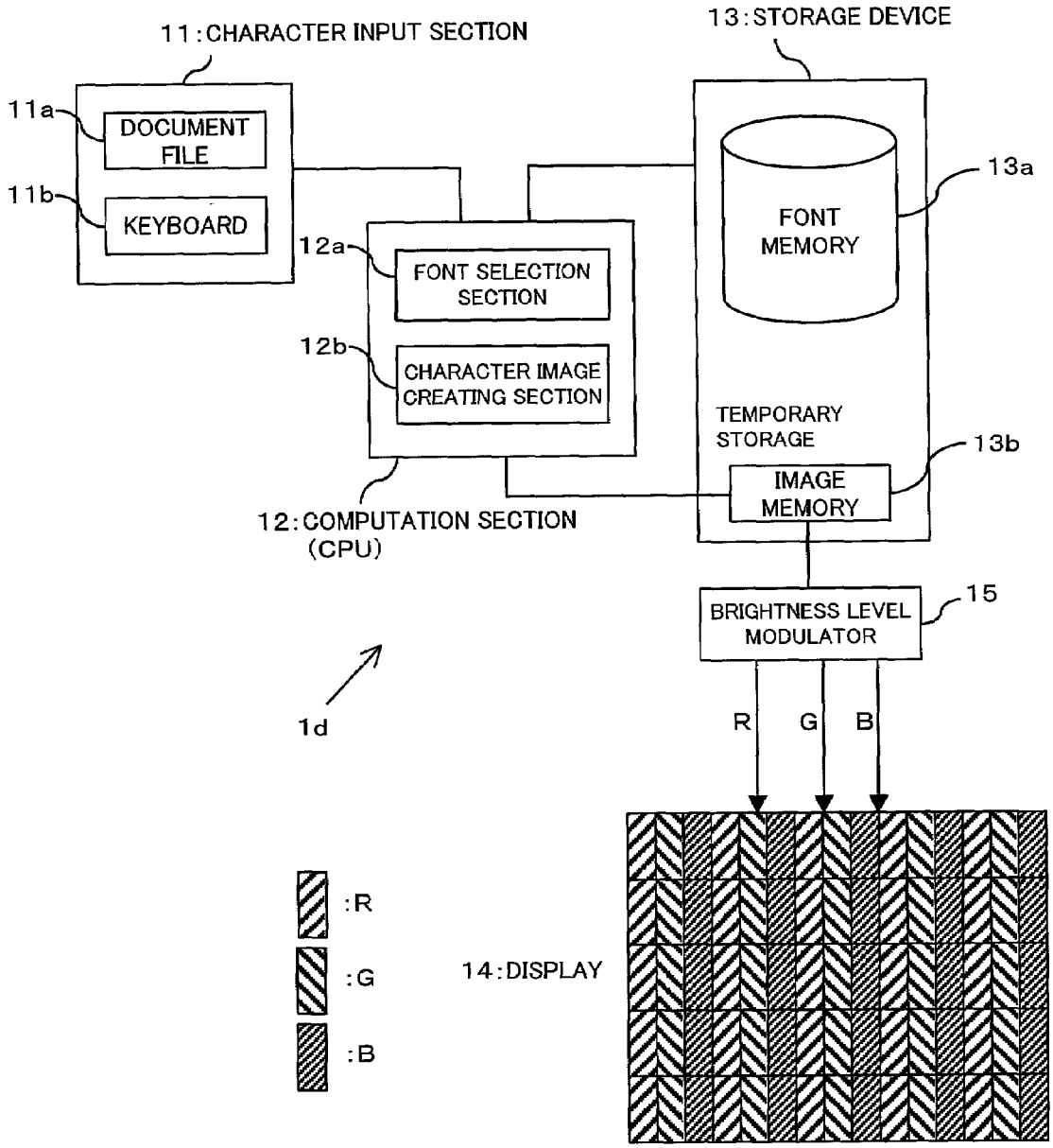
FIG. 12 is a block diagram showing the hardware configuration of a display apparatus serving as a modification of the second embodiment.

(D) Description of Modification of the Second Embodiment:

FIG. 12 is a block diagram showing the hardware configuration of a display apparatus 1*d* serving as a modification of a second embodiment of the present invention.

The display apparatus 1*d* shown in FIG. 12 is equipped with a brightness level modulator 15 disposed between the image memory 13*a* and the display 14, which are provided in the display apparatus 1*a* shown in FIG. 2 (or in the display apparatus 1*b* or 1*c*).

The brightness level modulator 15 is constructed so as to have the function of serving as the brightness value converting section 7 provided in the display apparatus 1*c* described in connection with the second embodiment. The brightness level modulator 15 converts the first brightness values that is to be directed to the respective display elements 10 of the display section 2 (or the display 14) from the element brightness value computing section 5 (or the letter image creating section 12*b*) into the second brightness values in accordance with lightness characteristics of the respective display elements 10. More specifically, the brightness level modulator (brightness value converting section) 15 is interposed between the element brightness value computing section 5 and the display section 2.

The brightness level modulator 15 implements the function of the brightness value converting section 7 by means of hardware. For instance, the brightness level modulator 15 is realized by means of passing a signal transmitted from an LCD controller (i.e., the element brightness value computing section 5 and the letter image creating section 12*b*) to an LCD (i.e., a color liquid crystal display: the display section 2 and the display 14) through an amplifier circuit. Alternatively, the brightness level modulator 15 may be realized by level correction of subjecting an RGB digital signal performed by a microcomputer before the digital signal enters the LCD controller.

With such a configuration, the display apparatus 1*d* serving as the modification of the second embodiment of the present invention can guarantee the same working effects and advantages as those of the display apparatus 1*c* described in connection with the second embodiment. The brightness value conversion section 7 in the form of the brightness value modulator 15 is interposed between the element brightness value computing section 5 (i.e., the letter image creating section 12*b*) and the display section 2 (i.e., the display 14). Since the brightness value converting section 7 as the brightness level modulator 15 converts, by the use of hardware, the first brightness values, which are output from the element brightness value computing section 5 to the respective rectangular display elements 10 of the display section 2 (i.e., lightness stabilization-and-conversion processing), to the second brightness value, the process to be performed by the computation section 12 (e.g., a CPU in a computer system) can be mitigated, thereby increasing processing speed.

The brightness value conversion section 7 performs the above-mentioned conversion operation in such a manner that the ratio among the second brightness becomes 0.600±0.100:0.384±0.100:1.000±0.100, when the three display elements 10 (i.e., an R display element 10, a G display element 10, and a B display element 10) are identical in brightness value. As a result, the display elements 10 emit light substantially identical in lightness, thereby providing an inconsistency-free image on the display 14.

Figure 13A:
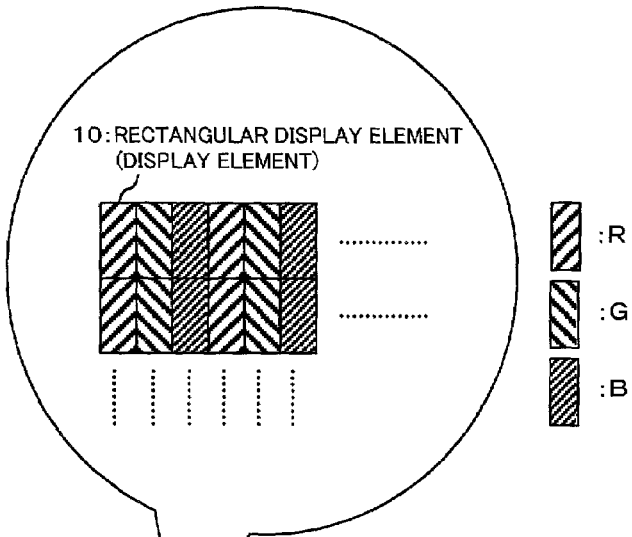
Figure 13B:
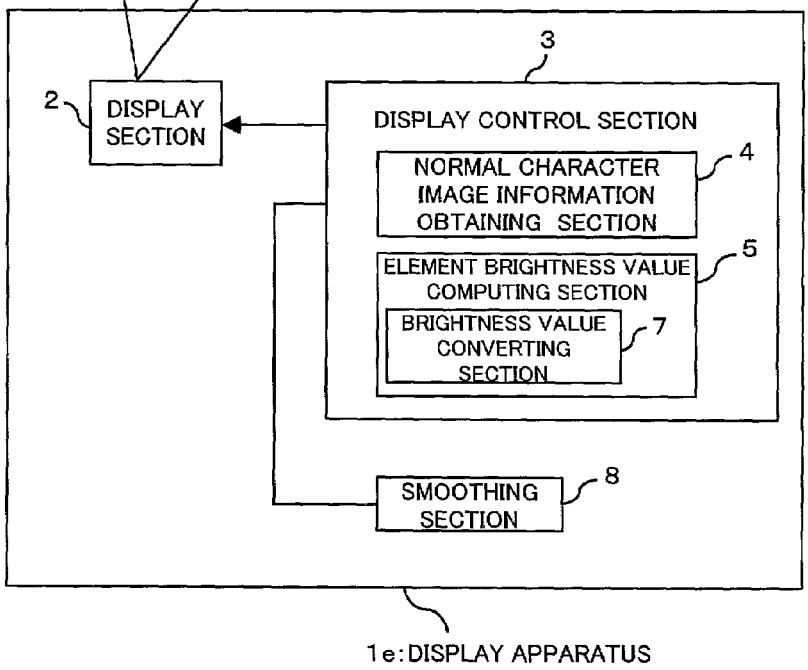

(E) Description of a Third Embodiment:

FIGS. 13A and 13B are illustrations for describing a display apparatus 1*e* according to a third embodiment of the present invention. FIG. 13A is an enlarged view showing a display section of the display apparatus 1*e*, and FIG. 13B is a block diagram showing the functional construction of the display apparatus 1*e*.

As shown in FIGS. 13A and 13B, a display apparatus 1*e* according to the third embodiment is provided in a computer system equipped with, e.g., a color liquid crystal display, as in the case of the display apparatus 1*c* according to the second embodiment. The display apparatus 1*e* further includes a smoothing section 8 in addition to the display apparatus 1*c* of FIG. 8B.

In these drawings, those reference numbers identical with those described previously designate identical or substantially identical elements or parts, and hence repetitious explanations thereof are omitted. The display apparatus 1*e* according to the third embodiment has the same hardware configuration as that of the display apparatus 1*a* (1*b*, 1*c*, or 1*d*) shown in FIG. 2, and detailed explanations thereof are also omitted.

Figure 14A:
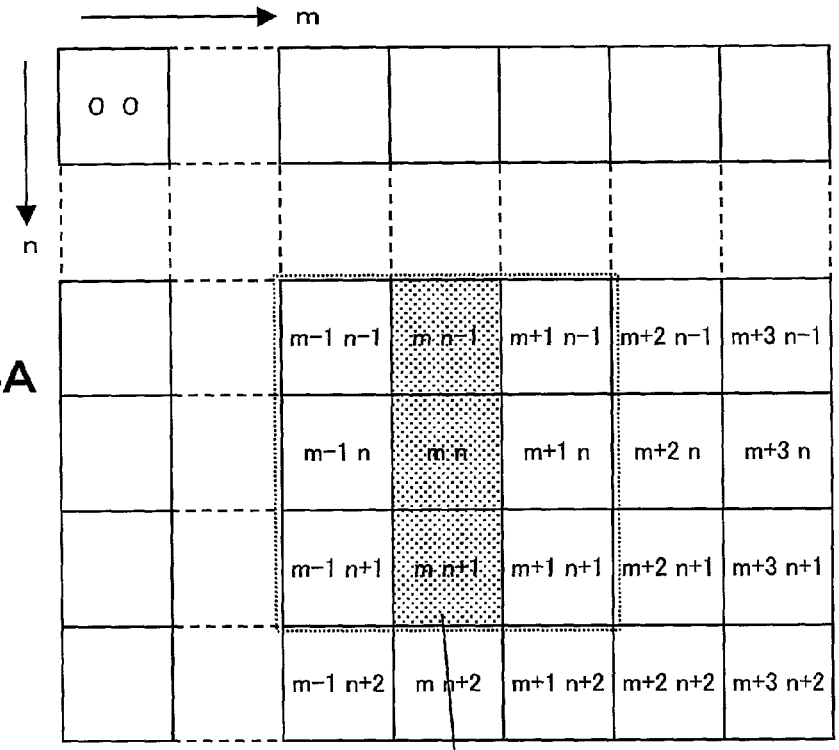
FIG. 14A is an illustration showing coordinates of pixels constituting a letter image.
Figure 14B:
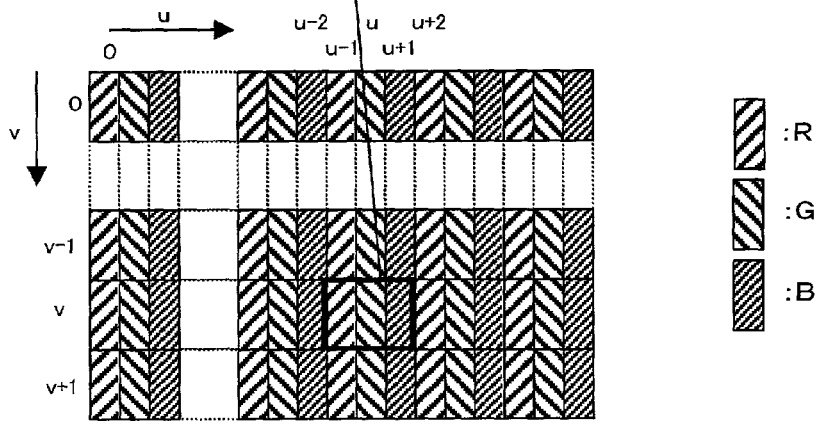
FIG. 14B shows coordinates of the display elements.

FIGS. 14A and 14B are illustrations for describing a coordinate conversion manner to be employed in the display apparatus 1*e* according to the third embodiment. FIG. 14A is an illustration showing coordinates of each pixels constituting a letter image, and FIG. 14B shows display coordinates of the respective display elements 10.

Likewise the display apparatus 1*c* shown in FIG. 8B, in the display apparatus 1*e* according to the present embodiment, there are three display elements 10, which emit light in respective different colors. More specifically, the display apparatus 1*e* includes the display 14 formed by a plurality of sets of three rectangular display elements 10 (hereinafter simply called "display elements") which emit light of R (red), G (green), and B (blue).

In the display apparatus 1*e* according to the third embodiment, as shown in FIGS. 14A and 14B, the display control section 3*b* display a display object using the display elements 10 each corresponding to three pixels successively arranged in the longitudinal direction (i.e. the vertical direction in FIG. 14B) parallel to the longitudinal center line of the individual display elements 10 so that three display elements that are different in color are represented by a group of pixels of a 3×3 matrix.

More specifically, the three display elements 10 located at coordinates (u−1, v), (u, v), (u+1, v) shown in FIG. 14B corresponds to pixels located at coordinates (m−1, n−1), (m−1, n), (m−1, n+1), (m, n−1), (m, n), (m, n+1), (m+1, n−1), (m+1, n), (m+1, n+1) on the letter image shown in FIG. 14A so that the display 14 display the letter image using the three display elements 10 that are represented by a group of nine pixels in a 3×3 matrix.

In the third embodiment, the group of pixels in a 3×3 matrix has the shape of a square lattice.

Figures 15A, 15B:
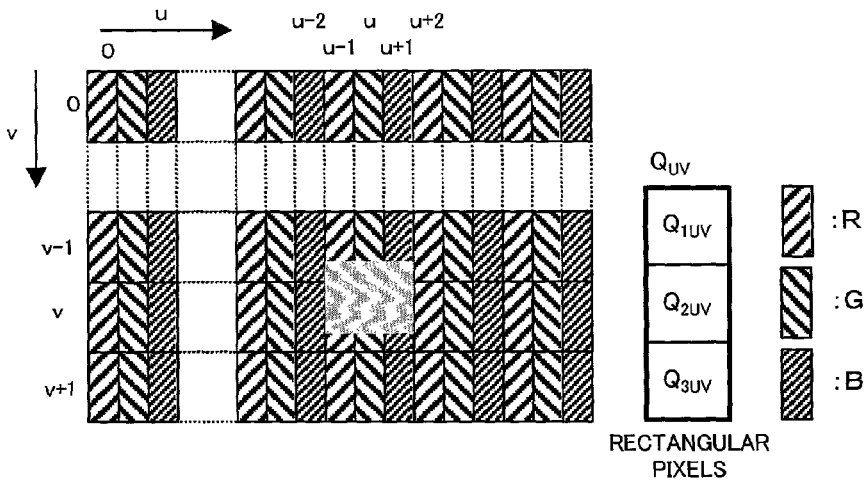
FIG. 15A is an enlarged view showing display elements.
FIG. 15B shows a matrix-shaped filter to be used for smoothing operation.

FIGS. 15A and 15B are illustrations for describing a filtering operation to be performed by the smoothing section 8. FIG. 15A is an enlarged view showing the display elements 10, and FIG. 15B shows a matrix-shaped filter to be used for the smoothing operation.

As shown in FIG. 15A, the smoothing section 8 smoothes the first brightness value, which have been computed by the element brightness value computing section 5, of the respective display elements 10 with a matrix-shaped filter (hereinafter simply called "filter") of FIG. 15B, as each of the display elements 10 is regarded as three segments successively arranged in the longitudinal direction and having one-third of the first brightness value, respectively.

As shown in FIG. 15A, a rectangular pixel is formed from three virtual pixels. The brightness value of the individual rectangular pixel becomes the total sum of brightness values respectively provided for the three virtual pixels (pixel contributions), as will be described below. Here, Q denotes a brightness value of a letter image mapped onto a liquid crystal element, and subscripts 1, 2, and 3 denote respective virtual pixels.

$$Q_{UV}=Q_{1UV}+Q_{2UV}+Q_{3UV}$$

A filtered brightness value Q' of the rectangular pixel after filtering operation is expressed by the following equation.

$$Q'=Q'_{1UV}+Q'_{2UV}+Q'_{3UV}$$

The filtering operation with respect to a filtered brightness value $Q'_1$ provided for the virtual pixel 1 is expressed by the following equation. Here, the filtered brightness value is normalized by making a total sum of values $f_{11}$ through $f_{33}$ constituting a filter 1.0.

$$Q'_{1UV}=\tfrac{1}{3}(f_{11}Q_{3U-1\ V-1}+f_{12}Q_{3U\ V-1}+f_{13}Q_{3U+1\ V-1}+f_{21}Q_{1U-1V}+f_{22}Q_{1UV}+f_{23}Q_{1U+1V}+f_{31}Q_{2u-1V}+f_{32}Q_{2U}+f_{33}Q_{2U+1V})$$

Figure 16A:
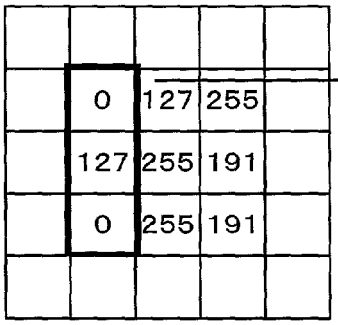
FIG. 16A is an enlarged view of a letter image.
Figure 16B:
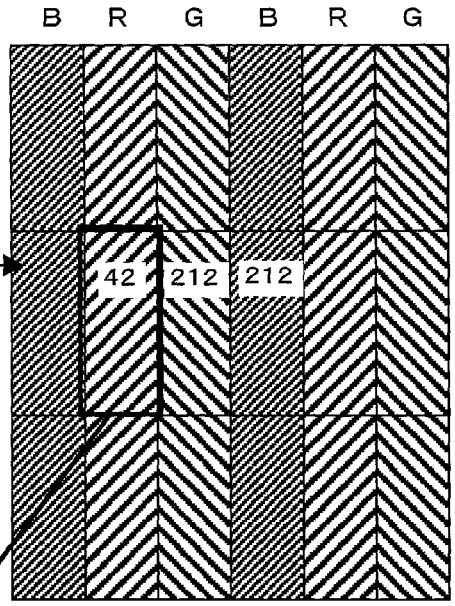
FIG. 16B is an enlarged view of the display element.
Figure 16C:
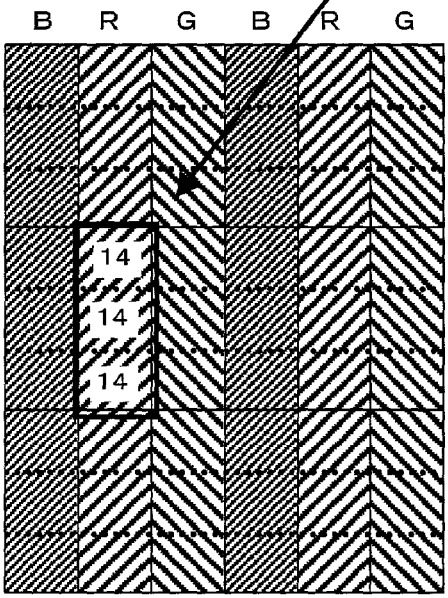
FIG. 16C is an illustration for describing a manner of applying a filter.
Figure 16C:
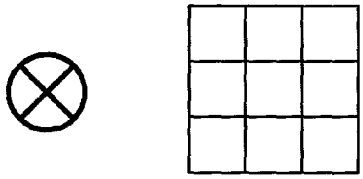

FIGS. 16A through 16C are illustrations for describing a smoothing manner. FIG. 16A is an enlarged view of a letter image; FIG. 16B is an enlarged view of the display element 10; and FIG. 16C is an illustration for describing a manner of applying the filter. The smoothing operation carried out by the smoothing section 8 will be described with reference to FIGS. 16A through 16C.

There will now be described a case where a display object is displayed with an R display element 10, which is enclosed by a thick line in FIG. 16B, corresponding to three pixels (having a pixel values of 0, 127, 0) enclosed by a thick line in FIG. 16A.

The letter image creating section 12*b* obtains an average of a pixel sequence consisting of three pixels successively arranged in the longitudinal direction parallel to the longitudinal center lines of the R-G-B display elements 10.

The average pixel value P' of the three pixels is computed in accordance with the following equation. The average pixel value P' of the three pixels with respect to an R display element 10 is denoted by symbol $P'_R$. Similarly, the average pixel value with respect to G, B display elements 10 are denoted by symbol $P'_G$, $P'_B$, respectively.

$$P'_R=(P_{m-1n-1}+P_{m-1n}+P_{m-1n+1})/3$$

$$P'_G=(P_{mn-1}+P_{mn}+P_{mn+1})/3$$

$$P'_B=(P_{m+1n-1}+P_{m+1n}+P_{m+1n+1})/3$$

The average pixel value $P'_R$ of three pixels shown in FIG. 16A is computed in accordance with the following equation:

$$P'_R=(0+127+0)/3=42$$

Here, a value of "42" corresponds to a brightness value of the R display element 10. Brightness values of the R, G, B display elements 10 arranged in a layout direction (the horizontal direction in FIG. 16B) is respectively multiplied by corresponding filter values (hereinafter called provided values for pixels)

Further, regarding the R display element 10 as a set of three elements successively arranged in the longitudinal direction, the computed average pixel value $P'_R$ (42) is divided by 3. As shown in FIG. 16C, a single display element 10 is imaginarily divided into three elements, each having a pixel value of 14, for convenience.

The filtering operation is performed on the pseudo-divided segments using the filter in order to smooth the brightness values of the respective display elements 10.

In the third embodiment, pixels to be displayed on the display 14 are taken as a single unit of displaying, irrespective of their emitting colors (R, G, B). Since the display elements 10 are rectangular, actual brightness values of the display elements with respect to a letter, which is defined on a square matrix, cannot be set in its present form. For setting the actual brightness values, each of the display elements 10 is pseudo-divided into three segments in the longitudinal direction in order that the respective display elements are regarded as three segments successively arranged in the longitudinal direction and having one-third of the computed brightness values of the corresponding display elements 10. The brightness values of the pixels constituting the image are respectively given to the pseudo-divided segments. More specifically, one-third of the brightness value of the corresponding display element 10 is given to each segment. Since the brightness values differ from actual display luminance, the brightness values are called contributions, for convenience.

FIGS. 17A through 17D show examples of a smoothing filter. The smoothing section 8 performs the smoothing operation using one or more smoothing filters shown in FIGS. 17A through 17D.

The smoothing filter shown in FIG. 17A is a 3×3 matrix pattern having three values E1, E2, and E3. The following formula stands among the values of E1 through E3.

$$4\times E1+4\times E2+E3=1.0$$

In each of the smoothing filters shown in FIGS. 17B through 17D, formulae shown below the respective matrix in the FIGS. stand between the values constituting each of the 3×3 matrix.

Figure 18:
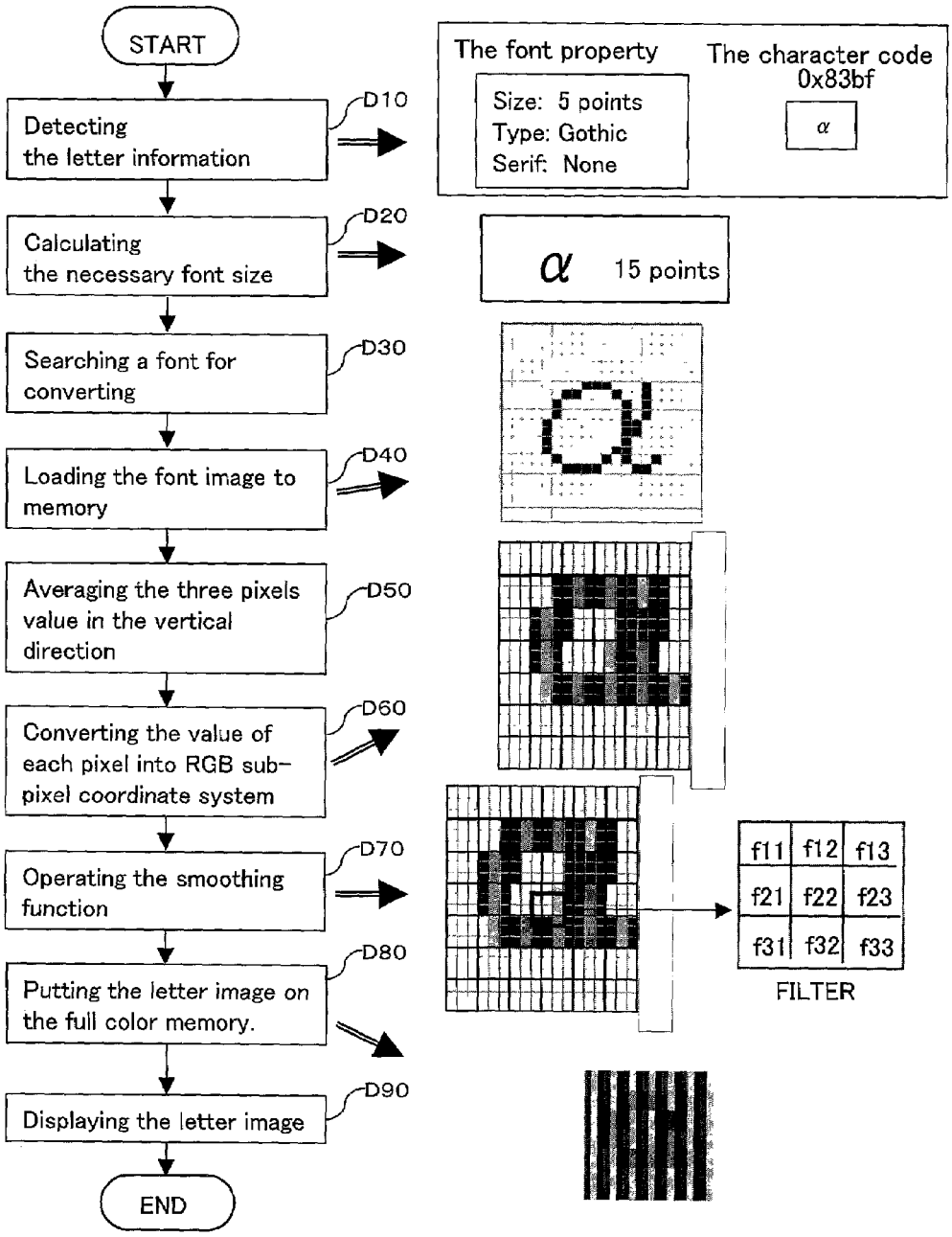
FIG. 18 is a flowchart for describing a process to be performed by the computation section in a high-resolution display mode of the display apparatus according to the third embodiment of the present invention.

A process to be performed by the computation section 12 (i.e., the display control section 3*b*) provided in the display apparatus 1*e* according to a third embodiment of the present invention will now be described with reference to a flowchart (steps D10 through D90) shown in FIG. 18.

When a letter code for specifying a letter to be displayed is entered from the letter input section 11 (step D10), the font selection section 12*a* acquires font size information about the original size of the letter, on the basis of the entered letter code.

The font selection section 12*a* calculates a letter size (e.g., point size 15) scaled up three times, in the longitudinal direction and layout direction, the original size (e.g., point size 5) of the letter image to be displayed (step D20). An identical letter image of the calculated size is called from the font memory 13*a* (step D30) to be loaded in the image memory 13*b* (step D40).

Next, the letter image creating section 12*b* computes an average of pixel values of each pixel sequence consisting of three pixels successively arranged in the longitudinal direction (i.e., performs normalization of a pixel sequence) (step D50), which pixels constitute the letter image loaded in the image memory 13*b*. The letter image creating section 12*b* converts the coordinates of the respective pixel into the coordinates of respective R-G-B display elements 10 (step D60) by applying the computed average pixel value to the rcorresponding display element 10.

Subsequently, the image letter creating section 12*b* computes a first brightness value of each of the display elements 10. Further, the first brightness values of the respective display elements 10 are smoothed with the filter (step D70), as each of the display elements 10 is regarded as three segments successively arranged in the longitudinal direction and having one-third of the first brightness value computed by the computation section 12 (the element brightness value computing section 5).

The letter image creating section 12*b* loads the smoothed brightness values into the multiple-tone (full color) memory (i.e., the image memory 13*b*) (step D80).

The computation section 12 (the display control section 3*a*) controls the light-emitting states of the respective display elements 10 in accordance with the smoothed brightness values loaded in the image memory 13*b* in such a manner that the letter image is displayed on the display 14 (step D90).

As mentioned above, the display apparatus 1*e* serving as the third embodiment of the present invention can guarantee the same working effects and advantages as those of the display apparatus 1*a* of the first embodiment. Since the smoothing section 8 smoothes the first brightness values of each of the display elements 10 regarding the individual display element 10 as three segments successively arranged in the longitudinal direction and having one third of the first brightness value of the corresponding display elements 10, which first brightness value is computed by the computation section 12 (the element brightness value computing section 5), it is possible to reduce jaggies on (the edge of) the letter image displayed on the display 14, thereby serving highly visible letters.

Additionally, since the matrix-shaped filter is square-lattice shape of a 3×3 matrix, it is possible to guarantee isotropy with respect to a more detailed area by applying thereto square filters. Further, it is possible to facilitate design filter because matrix anisotropy does not have to be considered. It is also possible to narrow the area affected by the filters as compared with conventional filters. More specifically, while a range influenced by a conventional filter is three times the longitudinal center line of a rectangular pixel, a range influenced by the filter of square-lattice shape becomes the other center line of the rectangular pixel in the illustrated example.

(F) Description of Modification of the Third Embodiment:

A display apparatus (not shown) according to a modification of the third embodiment is identical in configuration with the display apparatus 1*e* described in connection with the third embodiment, except that the smoothing section 8 smoothes pixel values included in the normal letter image information using the matrix-shaped filter.

Figure 19:
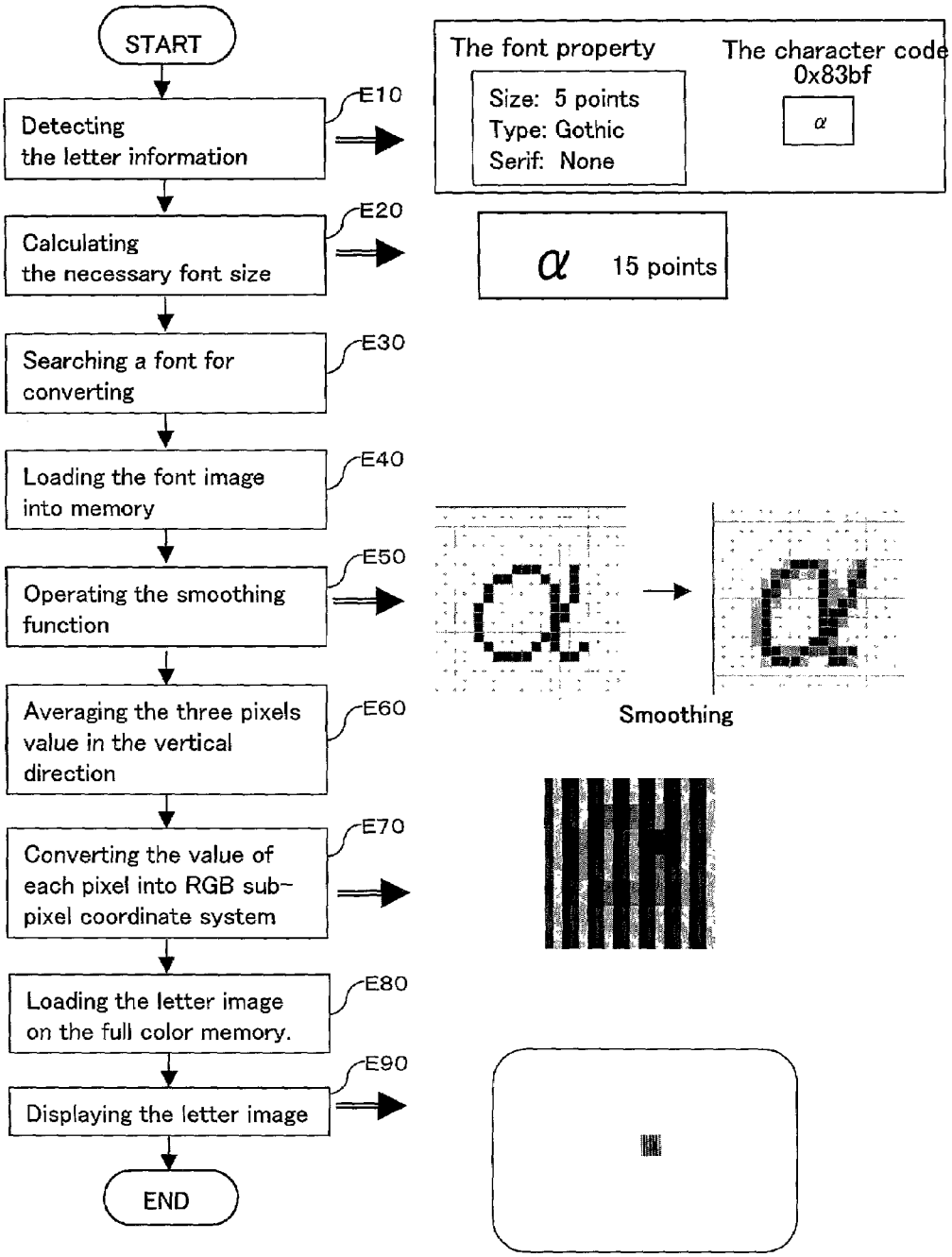
FIG. 19 is a flowchart for describing processing to be performed by the computation means in a high-resolution display mode of the display apparatus serving as a modification of the third embodiment.

A process to be performed in the computation section 12 (the display control section 3*b*) installed in the display apparatus of the modification of the third embodiment will now be described with reference to a flowchart (steps E10 to E90) shown in FIG. 19.

When a letter code for specifying a letter to be displayed is entered from the letter input section 11 (step E10), on the basis of the entered letter code the font selection section 12*a* acquires font size information about the original size of the letter.

The font selection section 12*a* calculates a size (e.g., point size 15) (step E20) scaled up three times, in both the longitudinal direction and layout direction, the original size (e.g., point size 5) of the letter image to be displayed. An identical letter image having the calculated size is called from the font memory 13*a* (step E30) to be loaded in the image memory 13*b* (step E40).

The letter image creating section 12*b* smoothes the brightness values of pixel values of the normal letter image information (step E50) by smoothing the brightness values of the respective display elements 10.

Subsequently, an average of pixel values of three pixels successively arranged in the longitudinal direction is computed (normalized) (step E60) with respect of the each pixel constituting the letter image. The letter image creating section 12*b* converts the pixel coordinates into coordinates of the R-G-B display elements 10 (step E70) by applying the computed average pixel values to the corresponding display elements.

The letter image creating section 12*b* loads the smoothed brightness value into the multiple-tone memory (the image memory 13*b*) (step E80).

In accordance with the brightness values loaded in the image memory 13*b*, the computation means 12 (or the display control section 3) controls the light-emitting states of the respective display elements 10 so as to display the letter in the letter image on the display 14 (step E90).

With such a configuration, the display apparatus serving as the modification of the third embodiment of the present invention can ensure the same working effects and advantages as those yielded by the display apparatus 1*e* of the third embodiment.

(G) Others:

The present invention utilizes principles as follows.

Figure 20:
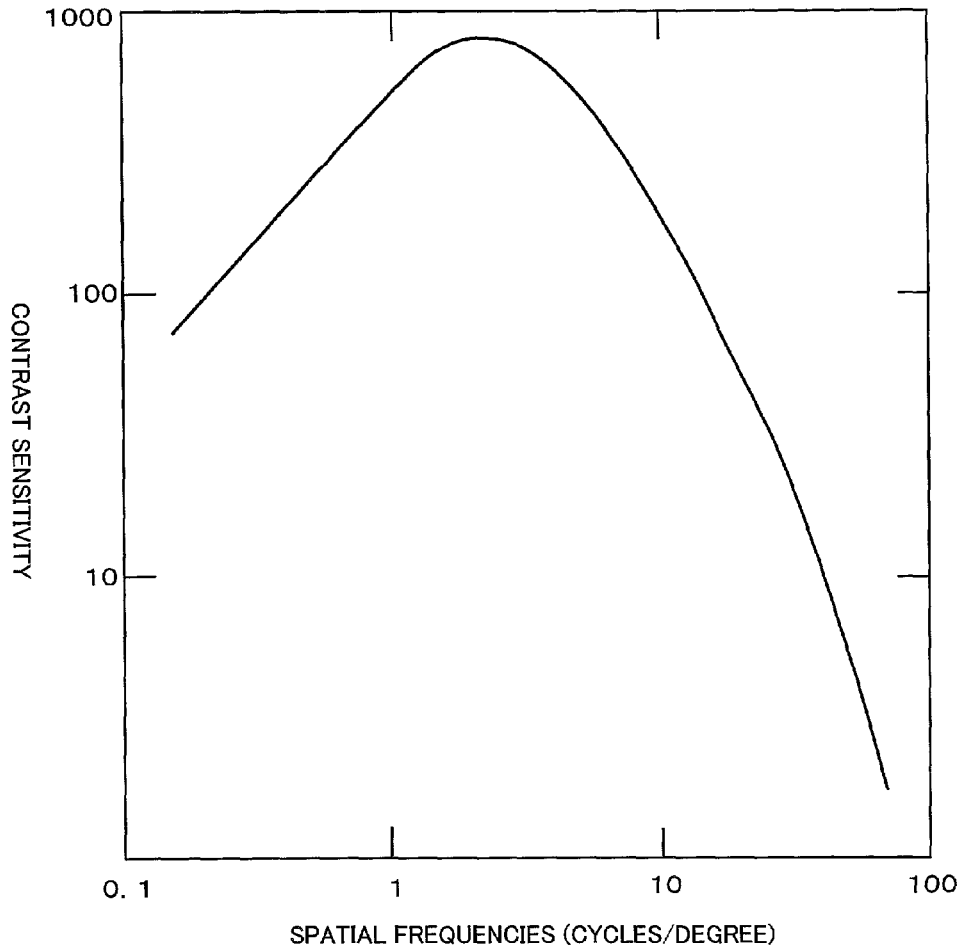
FIG. 20 is a plot showing the relationship between contrast sensitivity and spatial frequency.
Figure 21A:
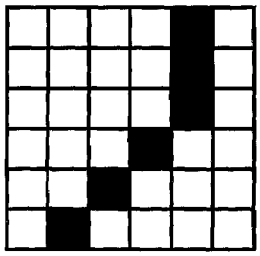
FIG. 21A RELATED ART
FIG. 21A is an enlarged view showing a portion of a letter image before processing.
Figure 21B:
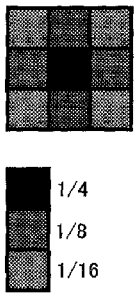
FIG. 21B RELATED ART
FIG. 21B is a view showing an example of a smoothing filter to be used for forming a grayscale font.
Figure 21C:
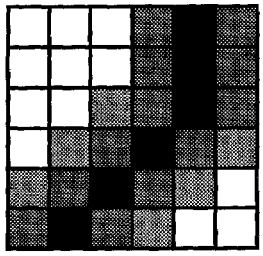
FIG. 21C RELATED ART
FIG. 21C is an enlarged view showing a portion of a produced grayscale font.

(1) Mixing of Colors Due to a Resolution Limit of the Human Eye:

FIG. 20 is a plot showing the relationship between contrast sensitivity and spatial frequency (excerpted from K. T. Spoehr and S. W. Lehmkuhle "Cognitive Science and Information Processing").

When an about 5-point letter is viewed from a distance at which an indicator is usually viewed (e.g., 300 mm), the letter has a visual angle of about 0.3 degrees. In this visual angle, a resolution having a spatial frequency of 1/0.3×7 (pixels)×3=70 (cycles/degree) is required for separating RGB pixels.

As shown in FIG. 20, when a spatial frequency becomes a value of 70 (cycles/degree), the contrast sensitivity has dropped to a value of 10 or less. It is very difficult for human eyes to resolve an element having such a level of contrast sensitivity. In this case, the RGB colors are not individually perceived, but the human eyes recognize the RGB colors in a mixture of these colors.

(2) Idiosyncrasy of Color Perception in a Narrow View Field:

It is that human eyes fail to discriminate hues at a visual angle of one degree or less. When small RGB elements are observed individually, an extreme difference among RGB colors is not perceived and the color sensing range of eyes becomes narrower. Accordingly, if RGB colors are appropriately dispersed, human eyes mainly observe the lightness information of a displayed letter.

From the principles (1) and (2) set forth, information about hues of RGB colors is not perceived by human eyes and the display is perceived as a mixture of colors upon perception of a high-resolution letter having a visual angle of one degree or less. In accordance with these principles, the present invention enables halftoning of a letter image by displaying a plurality of pixels with a plurality sets of three (R-G-B) elements.

Since only lightness information about mixed colors is effective, halftone steps in accordance with the lightness of each of the three elements are prepared.

As a result, since a stroke of a letter image can be displayed without involvement of enlargement of the stroke, it is possible to display a high-resolution letter.

Without regard to the previously-described embodiments, the present invention can be carried out in the form of various modification within the scope of the invention.

For example, in the modification of the first embodiment, the size determining section 6 determines whether or not a letter to be displayed by the display section 2 is equal to smaller than a preset standard size. On the basis of the result of the determination, a determination is made as to whether to display a letter image in either the normal display mode or the high-resolution display mode. Such discrimination manner may be applied to other embodiments as well as to the first embodiment.

The third embodiment employs a square matrix-shaped filter. However, the shape of the filter should by no means be limit to square. The filter may be another shape, such as a circular pattern.

Throughout the embodiments, sets of three display elements 10, each corresponding to three pixels, constituting the display section 2 (i.e., N=3, M=3); however the present invention should by no means be limited to the number of the display elements in the individual set and the number of the pixels corresponding to each display elements 10. Alternatively, M and N may take numbers other than three.

Although the embodiments have described the display apparatus according to the present invention, the present invention is not limited to such embodiments. The present invention may be applied to a display method for making a display section display a display object by controlling the light-emitting states of the respective display elements constituting the display section, a display controller for controlling the displaying state of the display section by controlling light-emitting states of the respective display elements constituting the display section, a display control method for controlling the displaying state of a display section by means of controlling the light-emitting state of display elements constituting the display section, and a letter image creating apparatus for creating a letter image.

Throughout the above-mentioned embodiments, the display section 2, the display control section 3, the normal letter image information obtaining section 4, the element brightness computing section 5, the size determining section 6, the brightness value converting section 7, and the smoothing section 8 may be realized by a computer executing a program. A program to be used for realizing these functions is provided in the form of a computer-readable recording medium; e.g., a flexible disk or a CD-ROM. A computer reads the program from the recording medium, and transfers to store the program into an internal or an external storage device. As an alternative, the program may be recorded on a memory device (or a recording medium); e.g., a magnetic disk, an optical disk, or a magnetoptiocal disk, and may be provided from the storage device to the computer via a communications circuit. Various preferred embodiments of the present invention will now be described with reference to the accompanying drawings.

Further, the present invention should by no means be limited to these foregoing embodiments, and various changes or modifications may be suggested without departing from the gist of the invention.

What is claimed is:

1. A display apparatus, comprising:

a display section, having a plurality of display elements for displaying a display object with N (N is a natural number larger than one) display elements per pixel, said N display elements are different in color from one another; and a display control section, communicably connected to said display section, for controlling the displaying state of said display section in terms of color factors of the respective display elements in such a manner that the display object is displayed with each display element corresponding to M (M is a natural number larger than two) pixels of the display object, wherein each display element is rectangular; said N display elements are successively arranged in a predetermined direction perpendicular to a longitudinal center line of the individual rectangular display elements, and wherein said display control section renders said display section to display the display object with said N rectangular display elements each corresponding to the M pixels successively arranged along the longitudinal center line of each of said rectangular display element so that said N display elements are represented by a group of pixels in an M×N matrix; and a luminance value converter converting, if said N display elements are identical in luminance value, said first luminance values to second luminance values in accordance with lightness characteristics of said respective N display elements in such a manner that said N display elements are identical in lightness.

2. A display apparatus according to claim 1, wherein:

the display object is an image of a letter; said display control section includes (a) a normal letter image information obtaining section for obtaining normal letter image information of a letter image which is N times larger than the original size of the last-named letter image in a longitudinal direction parallel to the longitudinal center lines of said display elements and N times larger than the original size of said letter image in said predetermined direction with said N display elements corresponding to each of the pixels of said letter image, and (b) an element luminance value computing section for computing first luminance values of the individual rectangular display elements, each corresponding to the M pixels successively arranged in said longitudinal direction, based on pixel values, provided one for each of the M pixels, of said normal letter image information; and said display control section varies the color factors of said display elements in accordance with said first luminance values, which are computed by said element luminance value computing section, in such a manner that said display section displays said letter image in the original size.

3. A method of displaying a display object on a display section of a display apparatus, comprising:

controlling a plurality of display elements constituting the display section, in which the display object is displayed with N (N is a natural number larger than one) display elements that are different in color from one another, each display element corresponding to more than two pixels; and converting, if said N display elements are identical in luminance value, said first luminance values to second luminance values in accordance with lightness characteristics of said respective N display elements in such a manner that said N display elements are identical in lightness.

4. A display controlling apparatus controlling the displaying state of a display section of a display apparatus in terms of color factors of a plurality of display elements, which constitute the display section, according to a process comprising:

displaying the display object on the display section with N (N is a natural number larger than one) display elements that are different in color from one another, each display element corresponding to more than two pixels; and computing first luminance values of each display element, each one corresponding to the more than two pixels successively arranged in a longitudinal direction, by obtaining an average of said pixel values of each of the more than two pixels and computing said first luminance values of each corresponding display element based on said average; and converting, if said N display elements are identical in luminance value, said first luminance values to second luminance values in accordance with lightness characteristics of said respective N display elements in such a manner that said N display elements are identical in lightness.

5. A letter image creating apparatus communicably connected to a display section of a display apparatus, for creating a letter image that is to be displayed on the display section, in which N (N is a natural number larger than one) rectangular display elements that are different in color from one another are successively arranged in a predetermined direction perpendicular to the longitudinal center line of the individual display element, each one of the N display elements corresponding to M (M is a natural number larger than two) pixels successively arranged along the longitudinal center line of the display element so that the N display elements are represented by a group of pixels in an M×N matrix, said apparatus comprising:

a normal letter image information obtaining section for obtaining normal letter image information for use in displaying a letter image which is M times larger than the original size of the last-named letter image in a longitudinal direction parallel to the longitudinal center lines of the display elements and N times larger than the original size of said letter image in said predetermined direction, in a such manner that N display elements display one pixel of said letter image in a coordinate manner; and an element luminance value computing section for computing first luminance values of the individual rectangular display elements, each one corresponding to the M pixels successively arranged in said longitudinal direction, based on pixel values, provided one for each of the M pixels, of said normal letter image information, wherein said element luminance value computing section obtains an average of said pixel values of the M pixels, and also computes said first luminance values of the corresponding rectangular display element based on said average; and a luminance value converting section for converting, if the N display elements are identical in luminance value, said first luminance values to second luminance values in accordance with lightness characteristics of the individual N rectangular display elements in such a manner that the N display rectangular elements are identical in lightness.

6. A letter image creating apparatus according to claim 5, wherein:

said element luminance value computing section serves to function as said luminance value converting section; and said element luminance value computing section performs the conversion of said first luminance values to said second luminance values simultaneously with the computation of the first luminance values.

7. A letter image creating apparatus according to claim 6, wherein:

the N rectangular display elements are three elements in red, green and blue, respectively; and if the three display elements are identical in luminance value, said luminance value converting section performs said conversion of said first luminance values in such a manner that a ratio of said second luminance values of the red, green, and blue elements is 0.600±0.100:0.384±0.100:1.000±0.100.

8. A letter image creating apparatus according claim 5; wherein:

said element luminance value computing section is connected to the display section via said luminance value converting section; and said luminance value converting section performs said converting on said first luminance values that is to be directed to each rectangular display element.

9. A letter image creating apparatus according to claim 8, wherein:

the N rectangular display elements are three elements in red, green and blue, respectively; and if the three display elements are identical in luminance value, said luminance value converting section performs said conversion of said first luminance values in such a manner that a ratio of said second luminance values of the red, green, and blue elements is 0.600±0.100:0.384±0.100:1.000±0.100.

10. A letter image creating apparatus according to claim 5, wherein:

the N rectangular display elements are three elements in red, green and blue, respectively; and if the three display elements are identical in luminance value, said luminance value converting section performs said conversion of said first luminance values in such a manner that a ratio of said second luminance values of the red, green, and blue elements is 0.600±0.100:0.384±0.100:1.000±0.100.

11. A letter image creating apparatus according to claim 5, further comprising a smoothing section for smoothing said first luminance values of the respective rectangular display elements with a matrix-shaped filter, as each display element is regarded as M elements successively arranged in said longitudinal direction and having one M-th of said first luminance value obtained by said element luminance value computing section.

12. A letter image creating apparatus according to claim 5, further comprising a smoothing section for smoothing each said pixel values of said normal letter image information with a matrix-shaped filter.

13. A computer-readable recording medium in which a letter image creating program for creating a letter image to be displayed on a display section of a display apparatus is recorded, the display section including N (N is a natural number larger than one) rectangular display elements that are different in color from one another and are successively arranged in a predetermined direction perpendicular to the longitudinal center line of the individual display element, each one of the N display elements corresponding to M (M is a natural number larger than two) pixels arranged along the longitudinal center line of the display element so that the N display elements are represented by a group of pixels in an M×N matrix, wherein said letter image creating program controls a computer according to a process comprising:

obtaining normal letter image information for use in displaying a letter image which is M times larger than the original size of the last-named letter image in a longitudinal direction parallel to the longitudinal center lines of the display elements and N times larger than the original size of said letter image in said predetermined direction, in such a manner that N display elements display one pixel of the letter image in a coordinate manner; and computing first luminance values of the individual rectangular display elements, each one corresponding to the M pixels successively arranged in said longitudinal direction, based on pixel values, provided one for each of the M pixels, of said normal letter image information, wherein said element luminance value computing further comprises obtaining an average of said pixel values of the M pixels, and also computing said first luminance values of the rectangular display elements based on said average; and converting, if the N display elements are identical in luminance value, said first luminance values to second luminance values in accordance with lightness characteristics of the individual N rectangular display elements in such a manner that the N rectangular display elements are identical in lightness.

14. The computer-readable recording medium according to claim 13, wherein said controlling by said letter image creating program further comprises smoothing said first luminance values of the respective display elements with a matrix-shaped filter, as each display element is regarded as M elements successively arranged in said longitudinal direction and having one M-th of said first luminance value computed by said element luminance value computing.

15. The computer-readable recording medium according to claim 13, wherein said controlling by said letter image creating program further comprises smoothing each said pixel values of said normal letter image information.

* * * * *

UNITED STATES PATENT AND TRADEMARK OFFICE

CERTIFICATE OF CORRECTION

PATENT NO. : 7,012,619 B2
APPLICATION NO. : 09/908621
DATED : March 14, 2006
INVENTOR(S) : Satoshi Iwata et al.

It is certified that error appears in the above-identified patent and that said Letters Patent is hereby corrected as shown below:

Col. 28, line 64, delete “in a such” and insert --in such a--, therefor.

Col. 29, line 38, after “claim 5” delete “;” and insert --,--, therefor.

Signed and Sealed this

Twenty-second Day of August, 2006

JON W. DUDAS
*Director of the United States Patent and Trademark Office*